US008602116B2

(12) United States Patent
Crabb

(10) Patent No.: US 8,602,116 B2
(45) Date of Patent: Dec. 10, 2013

(54) SEQUENCED PACKING ELEMENT SYSTEM

(75) Inventor: James Crabb, Arbrouth (GB)

(73) Assignee: Halliburton Energy Services, Inc., Houston, TX (US)

( * ) Notice: Subject to any disclaimer, the term of this patent is extended or adjusted under 35 U.S.C. 154(b) by 303 days.

(21) Appl. No.: 12/758,411

(22) Filed: Apr. 12, 2010

(65) Prior Publication Data

US 2011/0247835 A1 Oct. 13, 2011

(51) Int. Cl.
*E21B 33/12* (2006.01)
*E21B 33/128* (2006.01)

(52) U.S. Cl.
USPC ..... 166/387; 166/179; 166/188; 166/196; 277/337

(58) Field of Classification Search
USPC ..... 166/387, 196, 129, 179, 188; 277/327, 277/339, 337
See application file for complete search history.

(56) References Cited

U.S. PATENT DOCUMENTS

| | | | | |
|---|---|---|---|---|
| 2,589,332 | A | 3/1952 | Brown | |
| 2,632,514 | A | 3/1953 | Fitzpatrick | |
| 2,988,148 | A * | 6/1961 | Conrad et al. | 277/337 |
| 3,036,639 | A * | 5/1962 | Baker | 277/338 |
| 3,233,676 | A | 2/1966 | Lynes | |
| 3,282,346 | A | 11/1966 | Claycomb | |
| 3,339,637 | A * | 9/1967 | Holden | 166/128 |
| 3,605,886 | A | 9/1971 | Cox et al. | |
| 3,631,927 | A * | 1/1972 | Young | 166/134 |
| 4,326,588 | A * | 4/1982 | McStravick | 166/387 |
| 4,427,063 | A | 1/1984 | Skinner | |
| 4,436,150 | A | 3/1984 | Barker | |
| 4,438,933 | A * | 3/1984 | Zimmerman | 277/337 |
| 4,441,721 | A * | 4/1984 | Harris et al. | 277/342 |
| 4,518,037 | A | 5/1985 | Youngblood et al. | |
| 4,548,265 | A * | 10/1985 | Luke | 166/140 |
| 4,611,658 | A * | 9/1986 | Salerni et al. | 277/337 |
| 4,730,835 | A * | 3/1988 | Wilcox et al. | 277/342 |
| 4,765,404 | A * | 8/1988 | Bailey et al. | 166/117.6 |
| 4,809,989 | A * | 3/1989 | Kernal | 277/337 |
| 4,862,967 | A * | 9/1989 | Harris | 166/387 |
| 4,898,239 | A | 2/1990 | Rosenthal | |
| 5,117,913 | A * | 6/1992 | Themig | 166/310 |
| 5,176,217 | A * | 1/1993 | Luke et al. | 166/195 |
| 5,226,494 | A * | 7/1993 | Rubbo et al. | 166/250.17 |
| 5,311,938 | A * | 5/1994 | Hendrickson et al. | 166/134 |

(Continued)

FOREIGN PATENT DOCUMENTS

| | | |
|---|---|---|
| WO | 2009058021 A2 | 5/2009 |
| WO | 2012005871 A2 | 1/2012 |
| WO | 2012005871 A3 | 1/2012 |

OTHER PUBLICATIONS

Patent application entitled "Packing element system with profiled surface," by James Crabb, et al., filed Jul. 6, 2010 as U.S. Appl. No. 12/831,024.

(Continued)

*Primary Examiner* — Giovanna Wright
*Assistant Examiner* — Michael Wills, III
(74) *Attorney, Agent, or Firm* — Scott Wendorf; Conley Rose, P.C.

(57) ABSTRACT

A downhole retrievable dual directional isolation tool is provided. The down hole tool comprises a mandrel, a compressor concentric with the mandrel, and a packing element disposed around the mandrel, wherein a body section of the packing element is asymmetrical.

26 Claims, 15 Drawing Sheets

(56) References Cited

U.S. PATENT DOCUMENTS

| | | | | |
|---|---|---|---|---|
| 5,431,412 | A * | 7/1995 | Reinhardt et al. | 277/342 |
| 5,542,473 | A | 8/1996 | Pringle | |
| 6,044,908 | A | 4/2000 | Wyatt | |
| 6,446,717 | B1 * | 9/2002 | White et al. | 166/187 |
| 6,581,681 | B1 | 6/2003 | Zimmerman et al. | |
| 6,691,788 | B1 * | 2/2004 | Dearing | 166/382 |
| 6,705,615 | B2 | 3/2004 | Milberger et al. | |
| 6,843,480 | B2 * | 1/2005 | Nelson et al. | 277/338 |
| 7,210,533 | B2 * | 5/2007 | Starr et al. | 166/376 |
| 7,360,590 | B2 * | 4/2008 | Kossa et al. | 166/119 |
| 7,424,909 | B2 * | 9/2008 | Roberts et al. | 166/118 |
| 7,562,705 | B2 | 7/2009 | Cherewyk | |
| 7,673,693 | B2 * | 3/2010 | Standridge et al. | 166/387 |
| 7,721,799 | B2 | 5/2010 | Baski | |
| 7,810,558 | B2 | 10/2010 | Shkurti et al. | |
| 7,926,581 | B2 * | 4/2011 | Marshall et al. | 166/387 |
| 8,087,459 | B2 | 1/2012 | Caldwell et al. | |
| 8,091,640 | B2 | 1/2012 | Saltel | |
| 8,336,634 | B2 | 12/2012 | Eatwell et al. | |
| 2002/0121743 | A1 | 9/2002 | Crow et al. | |
| 2002/0166672 | A1 | 11/2002 | White et al. | |
| 2007/0056725 | A1 * | 3/2007 | Lucas et al. | 166/179 |
| 2008/0196884 | A1 * | 8/2008 | Doane et al. | 166/134 |
| 2008/0230236 | A1 * | 9/2008 | Wright et al. | 166/387 |
| 2008/0290602 | A1 | 11/2008 | Coronado | |
| 2011/0186307 | A1 * | 8/2011 | Derby | 166/386 |

OTHER PUBLICATIONS

Foreign communication from a related counterpart application—International Search Report and Written Opinion, PCT/US2011/040032, Feb. 9, 2012, 9 pages.

Foreign communication from a related counterpart application—International Search Report and Written Opinion, PCT/US2011/030789, Sep. 29, 2011, 8 pages.

Office Action dated Apr. 26, 2012 (24 pages), U.S. Appl. No. 12/831,024, filed Jul. 6, 2010.

Office Action (Final) dated Oct. 22, 2012 (11 pages), U.S. Appl. No. 12/831,024, filed Jul. 6, 2010.

Notice of Allowance dated Jan. 2, 2013 (7 pages), U.S. Appl. No. 12/831,024, filed Jul. 6, 2010.

Foreign communicaiton from a related counterpart application—International Preliminary Report on Patentability and Written Opinion, PCT/US2011/040032, Jan. 8, 2013, 5 pages.

Notice of Allowance, U.S. Appl. No. 121831,024, Jan. 2, 2013, 8 pages.

* cited by examiner

SEQUENCED PACKING ELEMENT SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Downhole tools and completion strings may use isolation devices and/or pressure barriers such as packers and others for isolating one zone from another or for isolating a plurality of zones. Some isolation tools are designed to maintain a pressure differential in one direction only, which may be referred to as unidirectional pressure barrier tools and/or unidirectional isolation tools. Other isolation tools are designed to maintain a pressure differential in both directions, which may be referred to as dual directional pressure barrier tools and/or dual directional isolation tools. Pressure on seals may be exerted by reservoir pressures, by pressure applied from the surface into an annulus, and by other pressure sources. Pressure may be exerted by liquids and/or gases. Some isolation devices and/or pressure barrier tools are designed to be deployed, to seal, to unseal, and to be retrieved from the wellbore, which may be referred to as retrievable tools.

SUMMARY

In an embodiment, a downhole retrievable dual directional isolation tool is disclosed. The downhole tool comprises a mandrel, a compressor concentric with the mandrel, and a packing element disposed around the mandrel, wherein a body section of the packing element is asymmetrical. An inside surface of the body section of the packing element may define at least one transverse groove, and a longitudinal center of the at least one groove may be located off a longitudinal center of the body section of the packing element and away from the compressor. A first end of the body section of the packing element may comprise a first transverse tensioner, and a second end of the body section of the packing element may comprise a second transverse tensioner, wherein the first end is located proximate to the compressor, and wherein the first transverse tensioner is stronger than the second transverse tensioner. The first transverse tensioner may be a first spring, and the second transverse tensioner may be a second spring, wherein the first spring is stronger than the second spring. A first end of the body section of the packing element may comprise a first material, and a second end of the body section of the packing element may comprise a second material, wherein the first end is located proximate to the compressor, and wherein the first material is harder than the second material. Further, the first material may comprise a first rubber material, and the second material may comprise a second rubber material, wherein the second rubber material has at least a 60 durometer hardness. The body section of the packing element may comprise a vent hole through the body section, wherein the vent hole is located off a longitudinal center of the body section of the packing element away from the compressor, wherein an interior surface of the body section of the packing element may define a groove extending from the vent hole across the longitudinal center of the body section of the packing element towards the compressor. The body section of the packing element may comprise a retaining means located in substantially the longitudinal center of the body section of the packing element to retard the swelling of a middle longitudinal portion of the body section of the packing element during setting of the tool and to retract the middle longitudinal portion of the body section of the packing element during unsetting of the tool. An inside surface of the body section of the packing element may define at least one transverse groove, wherein a longitudinal center of the at least one groove is located off a longitudinal center of the body section of the packing element and away from the compressor, wherein a first end of the body section of the packing element may comprise a first transverse tensioner and a second end of the body section of the packing element may comprise a second transverse tensioner, wherein the first end may be located proximate to the compressor, and wherein the first transverse tensioner is stronger than the second transverse tensioner. An inside surface of the body section of the packing element may define at least one transverse groove, wherein a longitudinal center of the at least one groove may be located off a longitudinal center of the body section of the packing element and away from the compressor, wherein a first end of the body section of the packing element may comprise a first material and a second end of the body section of the packing element may comprise a second material, wherein the first end may be located proximate to the compressor, and wherein the first material is harder than the second material. An inside surface of the body section of the packing element may define at least one transverse groove, wherein a longitudinal center of the at least one groove may be located off a longitudinal center of the body section of the packing element and away from the compressor, wherein the body section of the packing element may comprise a vent hole through the body section, wherein the vent hole is located off the longitudinal center of the body section of the packing element away from the compressor, and wherein an interior surface of the body section of the packing element may define a groove extending from the vent hole across the longitudinal center of the body section of the packing element towards the compressor. An inside surface of the body section of the packing element may define at least one transverse groove, wherein a longitudinal center of the at least one groove may be located off a longitudinal center of the body section of the packing element and away from the compressor, wherein a first end of the body section of the packing element may comprise a first transverse tensioner and a second end of the body section of the packing element may comprise a second transverse tensioner, wherein the first end may be located proximate to the compressor, wherein the first transverse tensioner is stronger than the second transverse tensioner, wherein the first end of the body section of the packing element may comprise a first material and the second end of the body section of the packing element may comprise a second material, and wherein the first material is harder than the second material. An inside surface of the body section of the packing element may define at least one transverse groove, wherein a longitudinal center of the at least one groove may be located off a longitudinal center of the body section of the packing element and away from the compressor, wherein a first end of the body section of the packing element may comprise a first transverse tensioner and a second end of the body section of the packing element may comprise a second transverse tensioner, wherein the first end may be located proximate to the compressor, and wherein the first transverse tensioner is stronger than the second transverse tensioner, wherein the body section of the packing element may comprise a vent hole through the body section, wherein the vent hole is located off the longitudinal center of the body section of the packing element away from the compressor, and wherein an interior surface of the body section of the packing element may define a groove extending from the vent hole across the longitudinal center of the body section of the packing element towards the compressor. An inside surface of the body section of the packing element may define at least one transverse groove, wherein a longitudinal center of the at least one groove may be located off a longitudinal center of the body section of the packing element and away from the compressor, wherein a first end of the body section of the packing element may comprise a first material and a second end of the body section of the packing element may comprise a second material, wherein the first end may be located proximate to the compressor, wherein the first material may be harder than the second material, wherein the body section of the packing element may define a vent hole through the body section, wherein the vent hole is located off the longitudinal center of the body section of the packing element away from the compressor, and wherein an interior surface of the body section of the packing element may define a groove extending from the vent hole across the longitudinal center of the body section of the packing element towards the compressor. An inside surface of the body section of the packing element may define at least one transverse groove, wherein a longitudinal center of the at least one groove may be located off a longitudinal center of the body section of the packing element and away from the compressor, wherein a first end of the body section of the packing element may comprise a first transverse tensioner and a second end of the body section of the packing element may comprise a second transverse tensioner, wherein the first end may be located proximate to the compressor, wherein the first transverse tensioner is stronger than the second transverse tensioner, wherein the first end of the body section of the packing element may comprise a first material and the second end of the body section of the packing element may comprise a second material, wherein the first material is harder than the second material, wherein the body section of the packing element may comprise a vent hole through the body section, wherein the vent hole is located off the longitudinal center of the body section of the packing element away from the compressor, and wherein an interior surface of the body section of the packing element may define a groove extending from the vent across the longitudinal center of the body section of the packing element towards the compressor. A first end of the body section of the packing element may comprise a first transverse tensioner and a second end of the body section of the packing element may comprise a second transverse tensioner, wherein the first end may be located proximate to the compressor, wherein the first transverse tensioner is stronger than the second transverse tensioner, wherein the first end of the body section of the packing element may comprise a first material and the second end of the body section of the packing element may comprise a second material, and wherein the first material may be harder than the second material. A first end of the body section of the packing element may comprise a first transverse tensioner and a second end of the body section of the packing element may comprise a second transverse tensioner, wherein the first end may be located proximate to the compressor, wherein the first transverse tensioner is stronger than the second transverse tensioner, wherein the body section of the packing element may comprise a vent hole through the body section, wherein the vent hole is located off a longitudinal center of the body section of the packing element away from the compressor, and wherein an interior surface of the body section of the packing element may define a groove extending from the vent hole across the longitudinal center of the body section of the packing element towards the compressor. A first end of the body section of the packing element may comprise a first transverse tensioner and a second end of the body section of the packing element may comprise a second transverse tensioner, wherein the first end may be located proximate to the compressor, wherein the first transverse tensioner is stronger than the second transverse tensioner, wherein the first end of the body section of the packing element may comprise a first material and the second end of the body section of the packing element may comprise a second material, wherein the first material may be harder than the second material, wherein the body section of the packing element may comprise a vent hole through the body section, wherein the vent hole is located off a longitudinal center of the body section of the packing element away from the compressor, and wherein an interior surface of the body section of the packing element may define a groove extending from the vent hole across the longitudinal center of the body section of the packing element towards the compressor. A first end of the body section of the packing element may comprise a first material and a second end of the body section of the packing element may comprise a second material, wherein the first material may be harder than the second material, wherein the body section of the packing element may comprise a vent hole through the body section, wherein the vent hole is located off a longitudinal center of the body section of the packing element away from the compressor, and wherein an interior surface of the body section of the packing element may define a groove extending from the vent hole across the longitudinal center of the body section of the packing element towards the compressor. In an embodiment, the tool may be retrievable using a wireline or an electrical line. In an embodiment, the body section may comprise a vent hole through the body section and the vent hole is reinforced. In an embodiment, the vent hole may be reinforced by at least one of a tube, a stent, and a spring.

In an embodiment, a method of servicing a wellbore is disclosed. The method comprises deploying a downhole dual directional isolation tool on a wireline or an electrical line into a wellbore casing, wherein the downhole dual directional isolation tool has an asymmetrical packing element. The method further comprises applying a compression force to a first end of the packing element and expanding a second end of the packing element to seal against a wall of the casing by continued application of the compression force, where the second end is opposite the first end of the packing element. After expanding the second end of the packing element to seal against the wall of the casing, the method further comprises expanding the first end of the packing element to seal against the wall of the casing by continued application of the compression force. The method may further comprise delaying the expansion of a middle portion of the packing element to seal against the wall of the casing until after expanding the second end of the packing element to seal against the wall of the casing. The method may further comprise expanding the middle portion of the packing element to seal against the wall of the casing before expanding the first end of the packing element to seal against the wall of the casing. The method may further comprise retracting the middle portion of the packing element to release the seal formed between the middle portion of the packing element and the wall of the casing. The method may further comprise energizing the seal formed between the packing element and the wall of the casing by a pressure differential between an interior of the isolation tool and a wellbore pressure on a compressor side of the seal.

In an embodiment, a downhole dual directional isolation tool is disclosed. The downhole dual directional isolation tool comprises a mandrel and a packing element disposed around the mandrel. The packing element is configured to provide a pressure barrier activated by compression force when a pressure differential across the packing element has a first direction and is configured to provide a pressure barrier activated by the pressure differential across the packing element when the pressure differential across the packing element has a direction opposite the first direction. In an embodiment, the packing element may comprise a hole through the packing element, wherein the hole is reinforced by at least one of a tube, a stent, and a spring.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
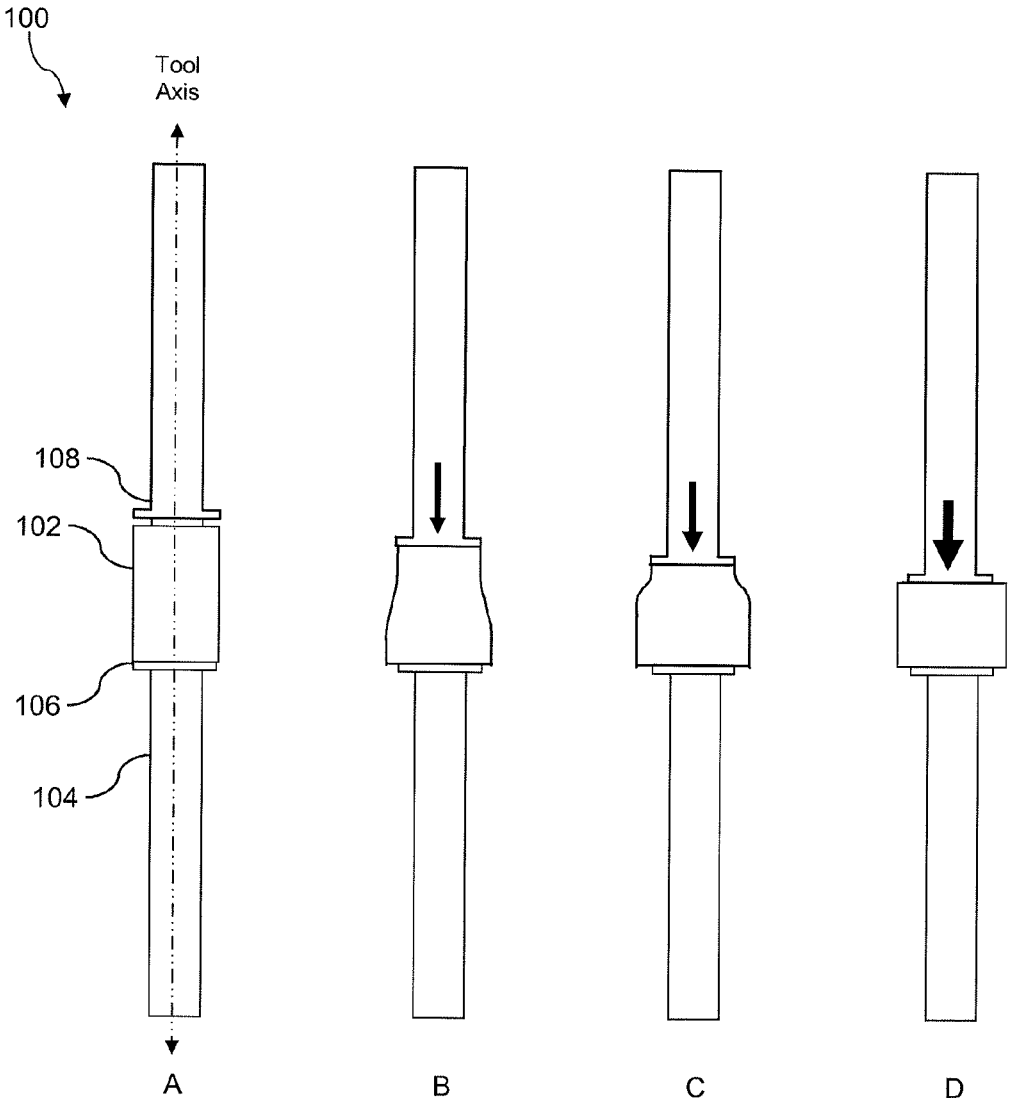
FIG. 1A is an illustration of a sequence of deployment of a packing element according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Dual directional packing elements that are symmetrical in form and construction may be expected to swell under compression and engage a casing of a wellbore in a predictable sequence. Typically, the middle part of the packing element begins to swell first in response to compression force exerted axially on the packing element. As the middle part of the packing element swells and engages the casing wall, friction force generated between the casing wall and the middle part of the packing element acts opposite to the direction of the compression force, causing the end of the packing element proximate to the point of application of the compression force to the packing element to swell next and engage the casing wall. As the end of the packing element proximate to the application of the compression force swells and engages the casing wall, friction force generated between the casing wall and the end of the packing element proximate to the application of compression force adds to the friction force generated between the casing wall and the middle part of the packing element and acts opposite to the direction of the compression force. With continued increased application of the compression force, the end of the packing element opposite to the application of the compression force swells last. Because of friction force generated between the casing wall and the middle part and the proximate end of the packing element, the full compression force may not be delivered to the opposite end of the packing element.

Under some conditions, upon completion of the packing element pack-off, a slight backlash or retreat of a forcing mechanism applying the compression force may occur, some or all of the friction forces may be released, and the end of the packing element opposite the application of compression force may remain under compressed. Under these circumstances, the packing element may seal positively when fluid and/or gas pressure is greater on the proximate end of the packing element than on the opposite end of the packing element, but the packing element may sometimes leak when the fluid and/or gas pressure is greater on the opposite end of the packing element than on the proximate end of the packing element. Performing the setting of the packing element with excess compression force may not have the intended result of providing the needed compression load to the end of the packing element opposite the application of compression force even in the presence of backlash and instead may cause damage to the end of the packing element proximate to the application of compression force or to the middle part of the packing element resulting from excessive compression force.

What is needed is a packing element that promotes distributing the compression load into the packing element more evenly, thereby enhancing sealing. In several embodiments, disclosed in detail below, a more even distribution of the compression load into the packing element is promoted by an asymmetrical packing element that changes the sequence of swelling of the packing element so that the end of the packing element opposite the point of application of the compression force swells and engages the casing wall before the end of the packing element proximate to the point of application of the compression force. In another embodiment disclosed below, an asymmetrical packing element relies upon compression loading to energize the sealing when the pressure differential exhibits higher pressure on the end of the packing element proximate to the application of compression force and relies upon the pressure on the end of the packing element opposite to the application of compression force propagating to an interior of the packing element and energizing the seal by inflating the packing element when the pressure differential exhibits higher pressure on the end of the packing element opposite to the application of compression force. It will be appreciated that the activation and/or energizing the seal of the packing element when the pressure is higher on the end of the packing element opposite to the application of compression force may be due partly to compression of the packing element and due partly to the pressure activation which may be referred to as a pressure boost, activation boost, and/or seal boost.

Turning now to FIG. 1A, a downhole tool 100 is described. The tool 100 comprises an asymmetrical packing element 102, a mandrel 104, a stop 106, and a compressor 108. In some contexts, the asymmetrical packing element 102 may be referred to as a packer element. In some contexts the tool 100 may be referred to as a packer, a retrievable packer, a bridge plug, and/or a retrievable bridge plug. The asymmetrical packing element 102 is disposed around the mandrel 104. The compressor 108 is concentric with the mandrel 104. It is understood that the tool 100 may comprise other components and structures which are not illustrated in FIG. 1A to avoid cluttering the illustration. The mandrel may extend through the packing element 102 and at least part way into the compressor 108. Unless otherwise specified, any use of any form of the terms "connect," "engage," "couple," "attach," or any other term describing an interaction between elements is not meant to limit the interaction to direct interaction between the elements and may also include indirect interaction between the elements described.

In an embodiment, the downhole tool 100 is retrievable by one of a wireline and an electrical line. Those skilled in the art appreciate that retrieving the downhole tool 100 using wireline or electrical line may impose structural limitations on the packing element 102. For example, a tool comprising a packing element that is suitable for retrieving using jointed pipe may not be suitable for retrieving using wireline or electrical line.

The packing element 102 is at least partially flexible and swells when compressed by the compressor 108 and resumes its former shape, at least partially, when compression forces are removed. In an embodiment, the packing element 102 may comprise rubber, but in other embodiments the packing element 102 may comprise other elastomeric material or materials.

In an embodiment, the packing element 102 comprises an elastomer. The elastomer may include any suitable elastomeric material that can melt, cool, and solidify onto a high density additive. In an embodiment, the elastomer may be a thermoplastic elastomer (TPE). Without limitation, examples of monomers suitable for use in forming TPEs include dienes such as butadiene, isoprene and hexadiene, and/or monoolefins such as ethylene, butenes, and 1-hexene. In an embodiment, the TPE includes polymers comprising aromatic hydrocarbon monomers and aliphatic dienes. Examples of suitable aromatic hydrocarbon monomers include without limitation styrene, alpha-methyl styrene, and vinyltoluene. In an embodiment, the TPE is a crosslinked or partially crosslinked material. The elastomer may have any particle size compatible with the needs of the process. For example, the particle size may be selected by one of ordinary skill in the art with the benefits of this disclosure to allow for easy passage through standard wellbore servicing devices such as for example pumping or downhole equipment. In an embodiment, the elastomer may have a median particle size, also termed d50, of greater than about 500 microns, alternatively of greater than about 550 microns, and a particle size distribution wherein about 90% of the particles pass through a 30 mesh sieve US series.

In an embodiment, packing element 102 may comprise a resilient material. Herein resilient materials may refer to materials that are able to reduce in volume when exposed to a compressive force and return back to about their normal volume (e.g., pre-compressive force volume) when the compressive force subsides. In an embodiment, the resilient material returns to about the normal volume (e.g., to about 100% of the normal volume) when the compressive force subsides. In an alternative embodiment, the resilient material returns to a high percentage of the normal volume when the compressive force subsides. A high percentage refers to a portion of the normal volume that may be from about 70% to about 99% of the normal volume, alternatively from about 70% to about 85% of the normal volume, and further alternatively from about 85% to about 99% of the normal volume. Such resilient materials may be solids, liquids or gases.

In an embodiment, the packing element 102 is intended to provide a dual directional seal. A dual directional seal, as this term is intended to be construed in this disclosure, is suitable for establishing a seal with a casing wall that blocks flow of either fluid or gases across the seal in either direction, independently of the sense of the pressure differential that may exist between an annulus formed between the tool 100 and the wellbore casing on a first side of the asymmetrical packing element 102 and the annulus on the opposite side of the asymmetrical packing element 102. In an embodiment, the asymmetrical packing element 102 is intended for use to seal in the presence of high gas pressure differentials with zero leakage or very little leakage.

The asymmetric structure and/or design of the packing element 102 is suitable to creating a novel response to a compression force exerted in the direction from the compressor 108 towards the stop 106. The packing element 102 is illustrated in a relaxed state in frame A. The packing element 102 is illustrated in a first partial compressed state in frame B, where the end of the packing element 102 opposite the compressor 108 is expanded to engage a casing wall (not shown) first. The packing element 102 is illustrated in a second partial compressed state in frame C, where both the end of the packing element 102 opposite the compressor 108 and the middle portion of the packing element 102 have expanded to engage the casing wall, wherein the second partial compressed state is later in sequence to the first partial compressed state. The packing element 102 is illustrated in a third and fully compressed state in frame D where the end opposite the compressor 108, the middle portion, and the end proximate to the compressor 108 have each expanded to engage the casing wall. Progressively greater compression force is needed to sequence first to the state of frame B, second to the state of frame C, and finally to the state of frame D. This sequence may promote loading compression forces substantially evenly into each of the end of the packing element 102 opposite to the compressor 108, the middle portion of the packing element 102, and the end of the packing element 102 proximate to the compressor 108. The process of compressing the packing element 102 to fully engage the casing wall may be referred to in some contexts as pack-off of the packing element 102.

Figure 1B:
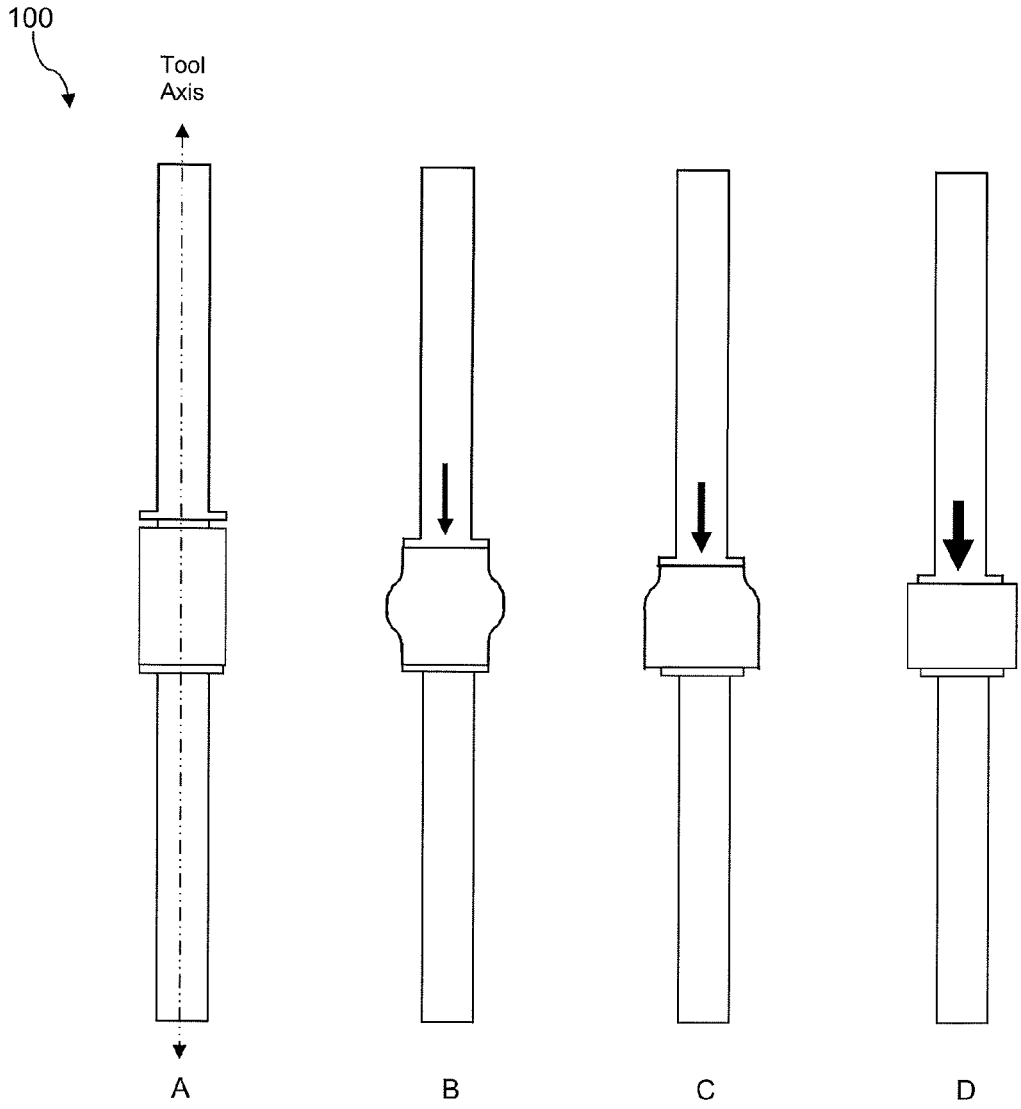
FIG. 1B is an illustration of a sequence of deployment of a packing element according to an embodiment of the disclosure.

Turning now to FIG. 1B, an alternative expansion sequence of the asymmetrical packing element 102 is described. In an embodiment, expansion of the packing element 102 by applying progressive compression force may involve the middle portion of the packing element 102 expanding first, the end of the packing element 102 opposite to the application of compression force expanding second, and the end of the packing element 102 proximate to the application of compression force expanding last. This alternative expansion sequence is also contemplated by the present disclosure and may provide some improved distribution of the compression load into the packing element 102.

In a sense, the described response of the asymmetrical packing element 102 to the increasing compression force may be said to be asymmetrical. It is a teaching of the present disclosure that if an asymmetrical response of the packing element 102 to increasing compression force exerted from one side is desired, the design of the packing element 102 should be asymmetrical. Hereinafter, a plurality of different embodiments of asymmetrical packing elements are described.

Figure 2A:
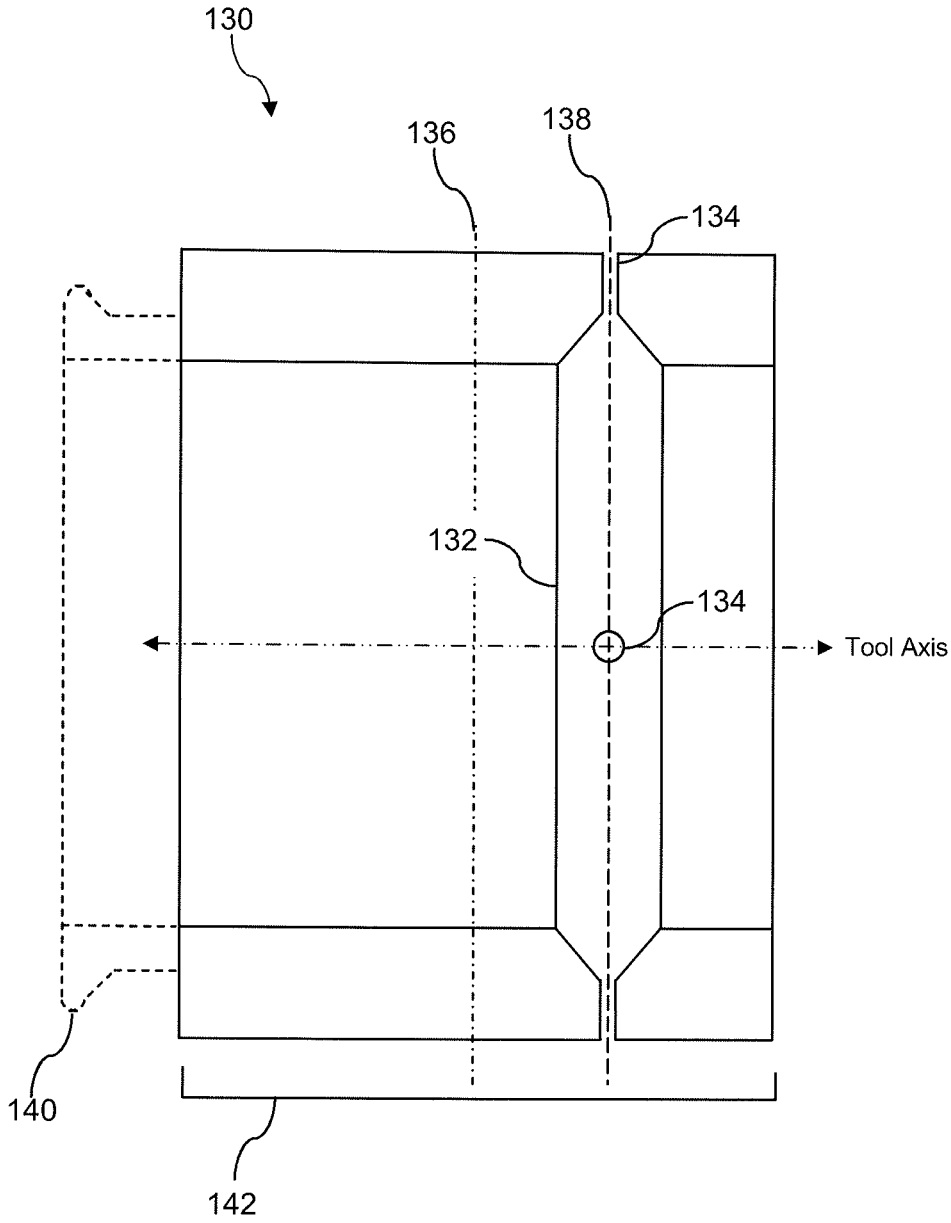
FIG. 2A is an illustration of a packing element in axial section view according to an embodiment of the disclosure.

Turning now to FIG. 2A, an embodiment of an asymmetrical packing element 130 is described. The packing element 130 is shown in axial section view in FIG. 2A. The packing element 130 may be comprised of rubber or of some other elastomeric material. An interior surface of the packing element 130 defines a first groove 132 (e.g, one or more circumferential grooves on a surface, e.g., interior surface, of the packing element) that provides a designed point of weakness to encourage expansion to occur first towards the end of the packing element 130 proximate to the first groove 132. The first groove 132 may be molded in the packing element 130 during manufacture. Alternatively, the first groove 132 may be cut or scalloped out of the packing element 130 after an initial manufacturing step. The packing element 130 has a central transverse axis 136. The central transverse axis 136 may be referred to in some contexts as the longitudinal center of the packing element 130. A plane perpendicular to the tool axis that intersects the central transverse axis 136 may be said to define a longitudinal center of the packing element 130 as the intersection of this plane with the packing element 130. A transverse groove axis 138 of the first groove 132 is offset from the central transverse axis 136 of the packing element 130, hence making the packing element 130 asymmetrical. The transverse groove axis 138 may be referred to in some contexts as a longitudinal center of the first groove 132. A plane perpendicular to the tool axis that intersects the transverse groove axis 138 may be said to define the longitudinal center of the first groove 132 as the intersection of this plane with the packing element 130. In some contexts, the first groove 132 may be referred to as a transverse groove.

In an embodiment, the packing element 130 optionally may comprise a lug 140. The lug 140 may be employed to restore the packing element 130 to its former shape and/or to retrieve the tool 100 from the wellbore. The lug 140 may be disposed at either end of the packing element 130. Alternatively, in an embodiment a lug 140 may be disposed at both ends of the packing element 130. While any of the various embodiments of packing elements 102, for example the packing element 130, discussed herein may optionally comprise one or more lugs such as the lug 140, the presence or absence of one or more lugs in the packing element 130 is not relevant to the novel structure of the various embodiments of packing elements 102 described herein. Additionally, the characterization of the packing elements 102 as being asymmetrical is based on a body section 142 of the packing element 130 that exhibits one or more asymmetric characteristics and which contributes to the novel structure of the subject packing element 102, for example the packing element 130.

The packing element 130 may further define a plurality of through holes 134 to promote venting of fluids and/or gases when the packing element 130 is compressed, to avoid a pressure lock condition. While illustrated located on the transverse groove axis 138, in an embodiment, the through holes 134 may be located off of the transverse groove axis 138. In one or more embodiments, the through holes 134 may be propped and/or reinforced by one or more tubes and/or partial length tubes, stents, spring devices, and/or other structures to reduce a tendency for the through holes 134 to close in response to deformation of the packing element 130 under compression forces. In an embodiment, some of the through holes 134 may be propped and/or reinforced while other through holes 134 are not propped or reinforced. In some contexts, one of the through holes 134 may be said to be a vent hole through the packing element 130 and/or a vent hole through the body section 142.

In an embodiment, the end of the packing element 130 proximate to the first groove 132 is disposed against the stop 106 over the mandrel 104, and the compressor 108 exerts a compression force originating from the opposite end of the packing element 130 from the first groove 132 and directed axially towards the first groove 132. It is anticipated that the packing element 130 will expand according to the sequence described above with reference to FIG. 1A frames B, C, and D. Alternatively, the packing element 130 may expand according to the sequence described above with reference to FIG. 1B frames B, C, and D.

Figure 2B:
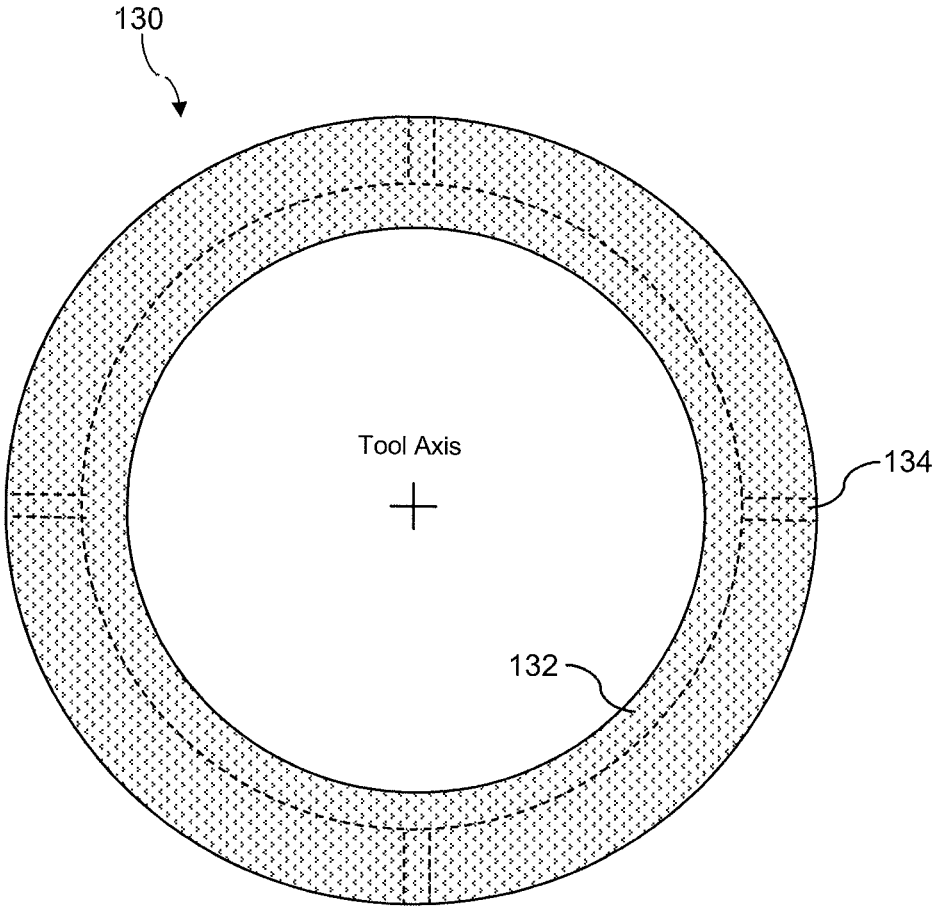
FIG. 2B is an illustration of a packing element in transverse section view according to an embodiment of the disclosure.

Turning now to FIG. 2B, the packing element 130 is shown in transverse section view. In an embodiment, the thickness of the packing element 130 may be about ⅙ to about ¼ the outside diameter of the packing element 130. In other embodiments, however, the thickness of the packing element 130 may be different. While four through holes 134 are illustrated in FIG. 2B, the packing element 130 may comprise any number of through holes 134, including only one through hole 134.

Figure 3:
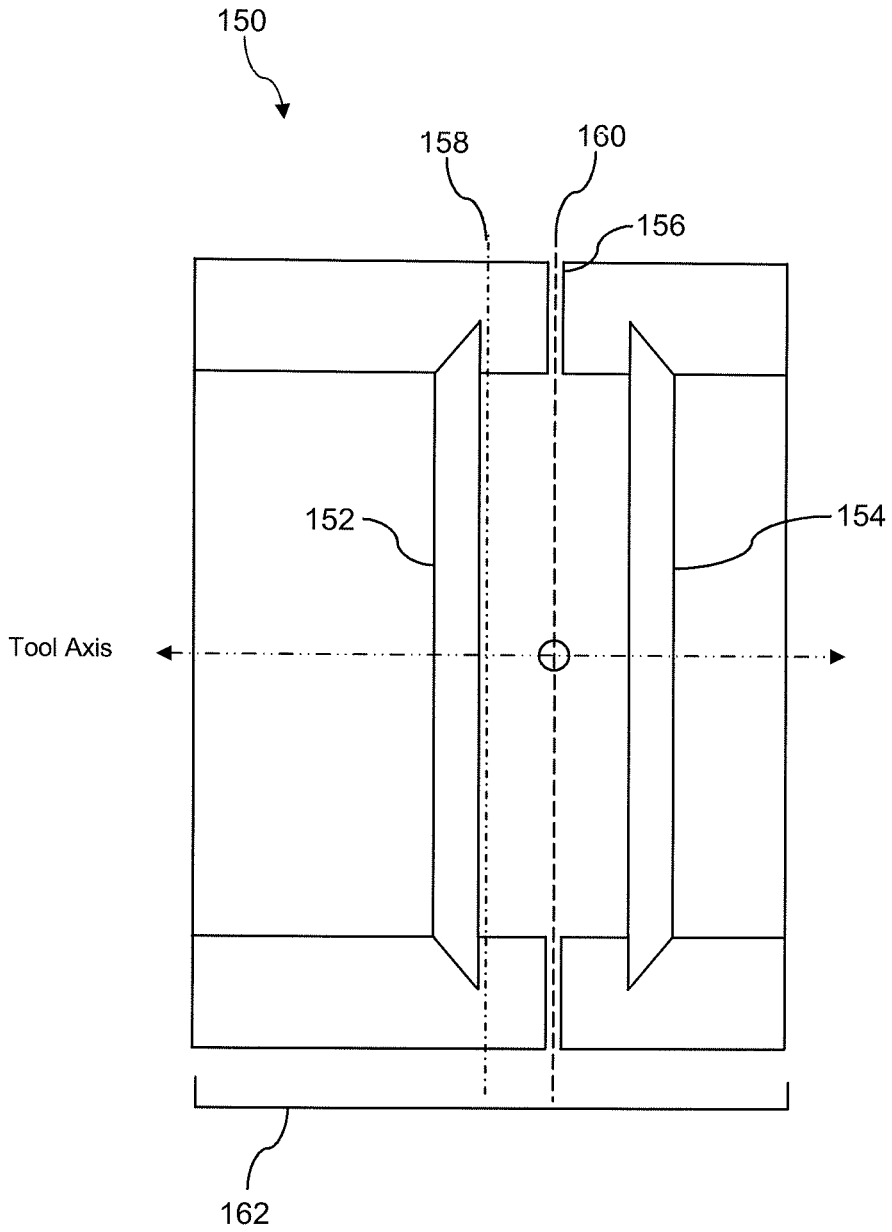
FIG. 3 is an illustration of a packing element in axial section view according to an embodiment of the disclosure.

Turning now to FIG. 3, an embodiment of an asymmetrical packing element 150 is described. The packing element 150 is shown in axial section view in FIG. 3. It is understood that the packing element 150 may have a transverse section view substantially similar to that of FIG. 2B. The packing element 150 may be comprised of rubber or of some other elastomeric material. An interior surface of the packing element 150 defines a second groove 152 and a third groove 154 that provide designed points of weakness or a designed area of weakness to encourage expansion to occur first towards the end of the packing element 150 proximate to the third groove 154. The grooves 152, 154 may be molded into the packing element 150 during manufacture. Alternatively, the grooves 152, 154 may be cut or scalloped out of the packing element 150 after an initial manufacturing step. The packing element 150 has a central transverse axis 158. The central transverse axis 158 may be referred to in some contexts as the longitudinal center of the packing element 150. A plane perpendicular to the tool axis that intersects the central transverse axis 158 may be said to define the longitudinal center of the packing element 150 as the intersection of this plane with the packing element 150. A transverse groove axis 160 is located midway between the second groove 152 and the third groove 154. The transverse groove axis 160 is offset from the central transverse axis 158, hence making the packing element 150 asymmetrical. The transverse groove axis 160 may be referred to in some contexts as a longitudinal center of the second and third grooves 152, 154. A plane perpendicular to the tool axis that intersects the transverse groove axis 160 may be said to define the longitudinal center of the second and third grooves 152, 154 as the intersection of this plane with the packing element 150. In some contexts, the second and third grooves 152, 154 may be referred to as transverse grooves.

The packing element 150 may further comprise a plurality of through holes 156 to promote venting of fluids and/or gases when the packing element 150 is compressed, to avoid a pressure lock condition. In one or more embodiments, the through holes 156 may be propped and/or reinforced by tubes and/or partial length tubes, stents, spring devices, and/or other structures to reduce a tendency for the through holes 156 to close in response to deformation of the packing element 150 under compression forces. In an embodiment, some of the through holes 156 may be propped and/or reinforced while other through holes 156 are not propped or reinforced. While illustrated located on the transverse groove axis 160, in an embodiment, the through holes 156 may be located off of the transverse groove axis 160. The packing element 150 comprises a body section 162 and may comprise one or more lugs (not shown) as discussed above with reference to FIG. 2A. When the packing element 150 is said to be asymmetrical, this characterization is relative at least to the asymmetrical structure of the body section 162. In some contexts, one of the through holes 156 may be said to be a vent hole through the packing element 150 and/or a vent hole through the body section 162.

In an embodiment, the end of the packing element 150 proximate to the third groove 154 is disposed against the stop 106 over the mandrel 104, and the compressor 108 exerts a compression force originating from the opposite end of the packing element 150 from the third groove 154 and directed axially towards the third groove 154. It is anticipated that the packing element 150 will expand according to the sequence described above with reference to FIG. 1A frames B, C, and D. Alternatively, the packing element 150 may expand according to the sequence described above with reference to FIG. 1B frames B, C, and D. Alternative embodiments of the packing element 150 may have three, four, or more grooves similar to grooves 152, 154. The transverse groove axis 160 would be located midway between the transverse axes of the several grooves, and the transverse groove axis 160 would be offset from the central transverse axis 158.

Figure 4A:
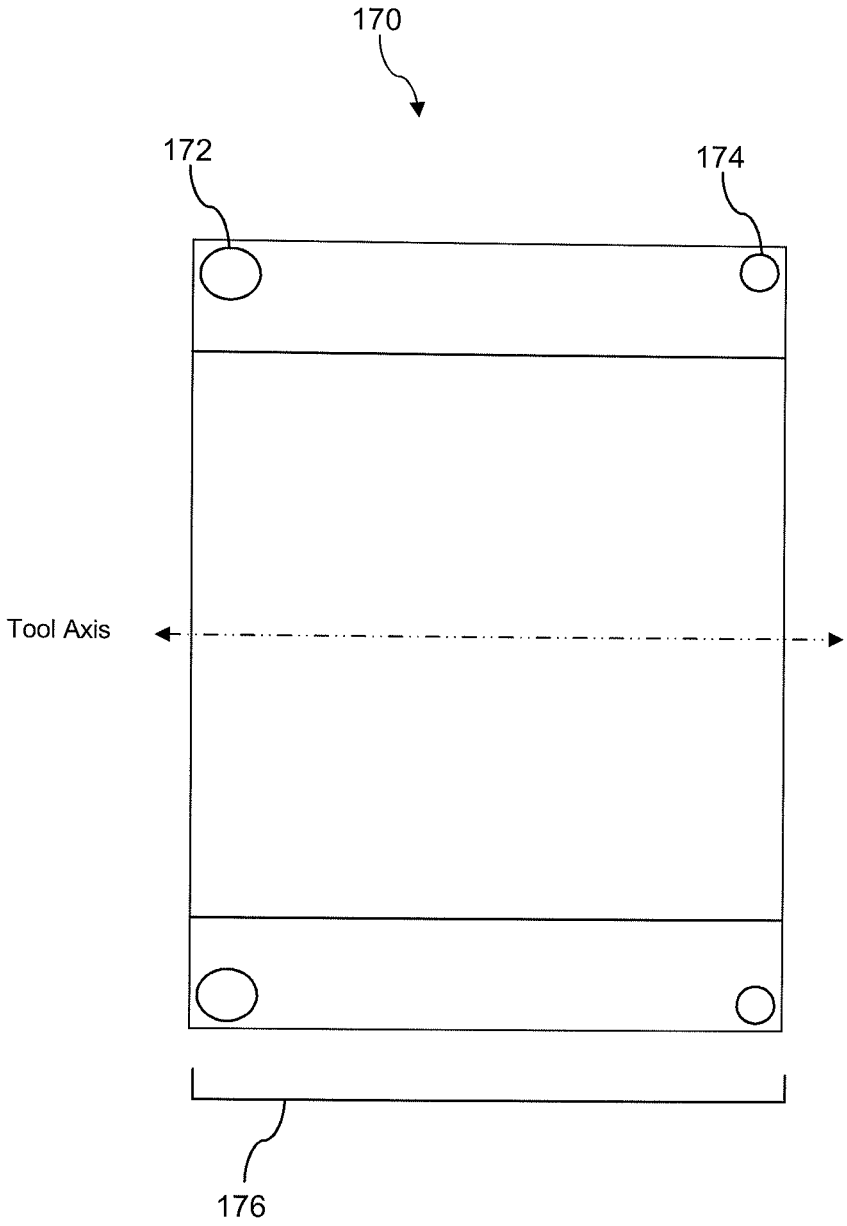
FIG. 4A is an illustration of a packing element in axial section view according to an embodiment of the disclosure.

Turning now to FIG. 4A, an embodiment of an asymmetrical packing element 170 is described. The packing element 170 is shown in axial section view in FIG. 4A. The packing element 170 may be comprised of rubber or of some other elastomeric material. The packing element 170 comprises a first tensioner device 172 and a second tensioner device 174. The packing element 170 comprises a body section 176 and may comprise one or more lugs (not shown) as discussed above with reference to FIG. 2A. When the packing element 170 is said to be asymmetrical, this characterization is relative at least to the asymmetrical structure of the body section 176. The first tensioner device 172 is located proximate to the point of application of the compression force to the packing element 170, and the second tensioner device 174 is located opposite to the point of application of the compression force. In an embodiment, the packing element 170 may comprise one or more through holes (not shown) to promote venting fluid and/or gas pressure between the interior and exterior of the packing element 170, to avoid a pressure lock condition. In one or more embodiments, the through holes may be propped and/or reinforced by tubes and/or partial length tubes, stents, spring devices, and/or other structures to reduce a tendency for the through holes to close in response to deformation of the packing element 170 under compression forces. In an embodiment, some of the through holes may be propped and/or reinforced while other through holes are not propped or reinforced. In some contexts, one of the through holes may be said to be a vent hole through the packing element 170 and/or a vent hole through the body section 176.

The tensioner devices 172, 174 act to restrain, attenuate, and/or retard the expansion of the respective proximate and opposite ends of the packing element 170. By design, the first tensioner device 172 is stronger than the second tensioner device 174 and acts to restrain, attenuate, and/or retard the expansion of the proximate end of the packing element 170 more than the second tensioner device 174 restrains, attenuates, and/or retards the expansion of the opposite end of the packing element 170. As a result of this different ability between the tensioner devices 172, 174 to restrain, attenuate, and/or retard expansion of an associated portion of the packing element 170, the expansion sequence of the packing element 170 can be controlled or biased to conform to a desired expansion sequence, for example the expansion sequence illustrated in FIG. 1A frames B, C, and D or the expansion sequence illustrated in FIG. 1B frames B, C, and D.

In an embodiment, the first tensioner device 172 may comprise a spring that is stronger than a spring comprising the second tensioner device 174. For example, in an embodiment, the spring constant of the spring comprising the first tensioner device 172 may be greater in magnitude than the spring constant of the spring comprising the second tensioner device 174. Applying the well known Hooke's Law of elasticity that may accurately predict linear spring forces while the tensioner devices 172, 174 are operating within their elastic limits, the linear force exerted by the tensioner devices 172, 174 may be represented as $$F=-kx$$

where k is the force constant of the subject spring, x is the linear displacement of the subject spring, and F is the linear force exerted by the subject spring. In the context of Hooke's Law, a first spring may be said to be stronger than a second spring when the force constant of the first spring is greater in amplitude than the force constant of the second spring. In an embodiment, the force constant of the first tensioner device 172 may be at least 5% greater than the force constant of the second tensioner device 174. In an embodiment, the force constant of the first tensioner device 172 may be at least 10% greater than the force constant of the second tensioner device 174. In an embodiment, the force constant of the first tensioner device 172 may be at least 20% greater than the force constant of the second tensioner device 174. In an embodiment, the force constant of the first tensioner device 172 may be at least 40% greater than the force constant of the second tensioner device 174. In an embodiment, the force constant of the first tensioner device 172 may be at least 80% greater than the force constant of the second tensioner device 174. In an embodiment, the force constant of the first tensioner device 172 may be at least 200% greater than the force constant of the second tensioner device 174. In an embodiment, the force constant of the first tensioner device 172 may be at least 300% greater than the force constant of the second tensioner device 174. In an embodiment, the force constant of the first tensioner device 172 may be at least 400% greater than the force constant of the second tensioner device 174. In an embodiment, the force constant of the first tensioner device 172 may be at least 500% greater than the force constant of the second tensioner device 174.

Alternatively, still in the context of Hooke's Law, a first spring analyzed in an initial state that is already displaced from the relaxed position may be said to be stronger than a second spring, notwithstanding the second spring having a force constant greater than the force constant of the first spring, over a specific range of linear displacement such that the linear force exerted by the first spring is greater than the linear force exerted by the second spring over the specific range.

The linear force exerted by the tensioner devices 172, 174 may be converted by one skilled in the art to a transverse force applied by the tensioner devices 172, 174 on the packing element 170, but this is not necessary to appreciating what is meant in this context by "stronger" and to appreciate that the stronger tensioner device may tend to retard the expansion of a portion of the packing element 170 proximate to the stronger tensioner device in the presence of the same compression force that initiates the expansion of a different portion of the packing element 170 proximate to the weaker tensioner device. In other embodiments, the tensioner devices 172, 174 may be modeled by mechanisms other than springs, for example by bungees or other elastic devices, and the parameters of these other models that characterize the relative strengths of the tensioner devices 172, 174 may be different from the force constant of Hooke's Law discussed above.

The tensioner devices 172, 174 may further contribute to the retraction of the packing element 170 prior to retrieving the tool 100 from the wellbore. The difference of the strength between the tensioner devices 172, 174 make the packing element 170 asymmetrical. In an embodiment, the end of the packing element 170 proximate to the second tensioner device 174 is disposed against the stop 106 over the mandrel 104, and the compressor 108 exerts a compression force originating from the opposite end of the packing element 170 from the second tensioner device 174 and directed axially towards the second tensioner device 174. It is anticipated that the packing element 170 will expand according to the sequence described above with reference to FIG. 1A frames B, C, and D. Alternatively, the packing element 170 may expand according to the sequence described above with reference to FIG. 1B frames B, C, and D.

The tensioner devices 172, 174 may be springs or other structures having spring-like properties, such as elastic materials. In an embodiment, in the relaxed state of the packing element 170, as is illustrated in FIG. 1A frame A, the tensioner devices 172, 174 may be in a relaxed state and may exert no forces on the packing element 170. In an embodiment, the tensioner devices 172, 174 in the fully compressed state, as is illustrated in FIG. 1A frame D, the first tensioner device 172 may wedge between the compressor 108 and the casing wall and the second tensioner device 174 may wedge between the stop 106 and the casing wall. In these wedged positions, the tensioner devices 172, 174 counter the tendency of the elastomeric material of the packing element 170 to extrude into the gap between the casing wall and the stop 106 and/or the compressor 108. In some contexts, the tensioner devices 172, 174 may be referred to as anti-extrusion devices.

Figure 4B:
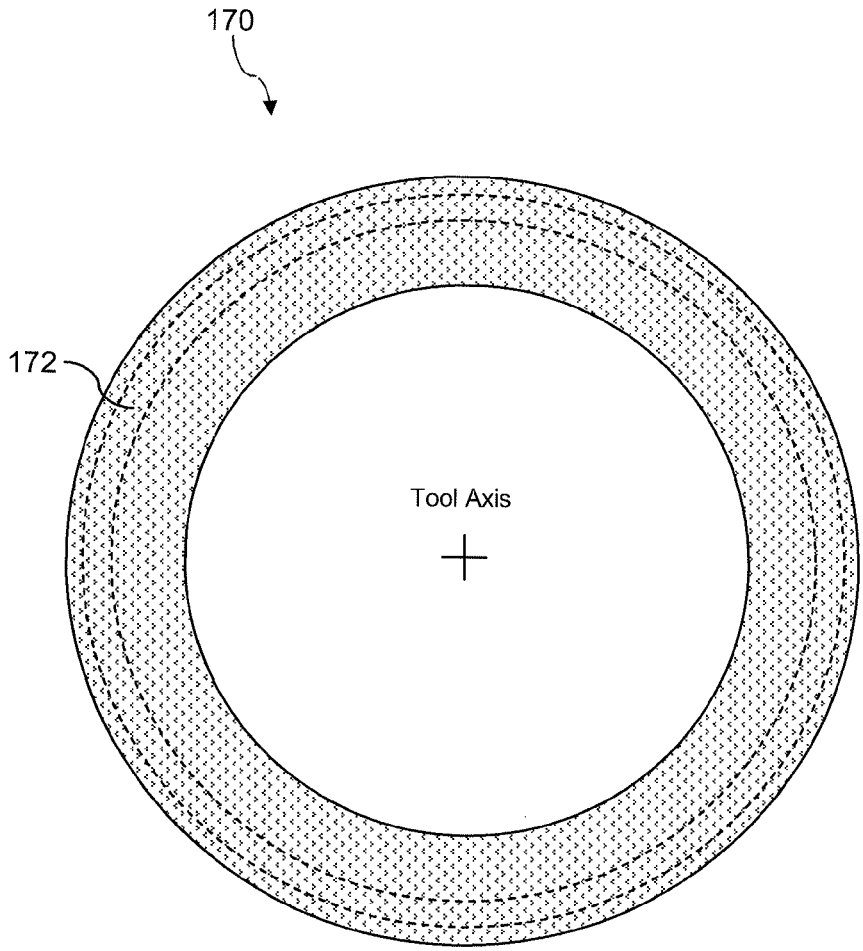
FIG. 4B is an illustration of a packing element in transverse section view according to an embodiment of the disclosure.

Turning now to FIG. 4B, the packing element 170 is shown in transverse section view. The selected view shows the first tensioner device 172, but a view showing the second tensioner device 174 would be substantially similar, with the possible exception that the second tensioner device 174 may be thinner.

Figure 5:
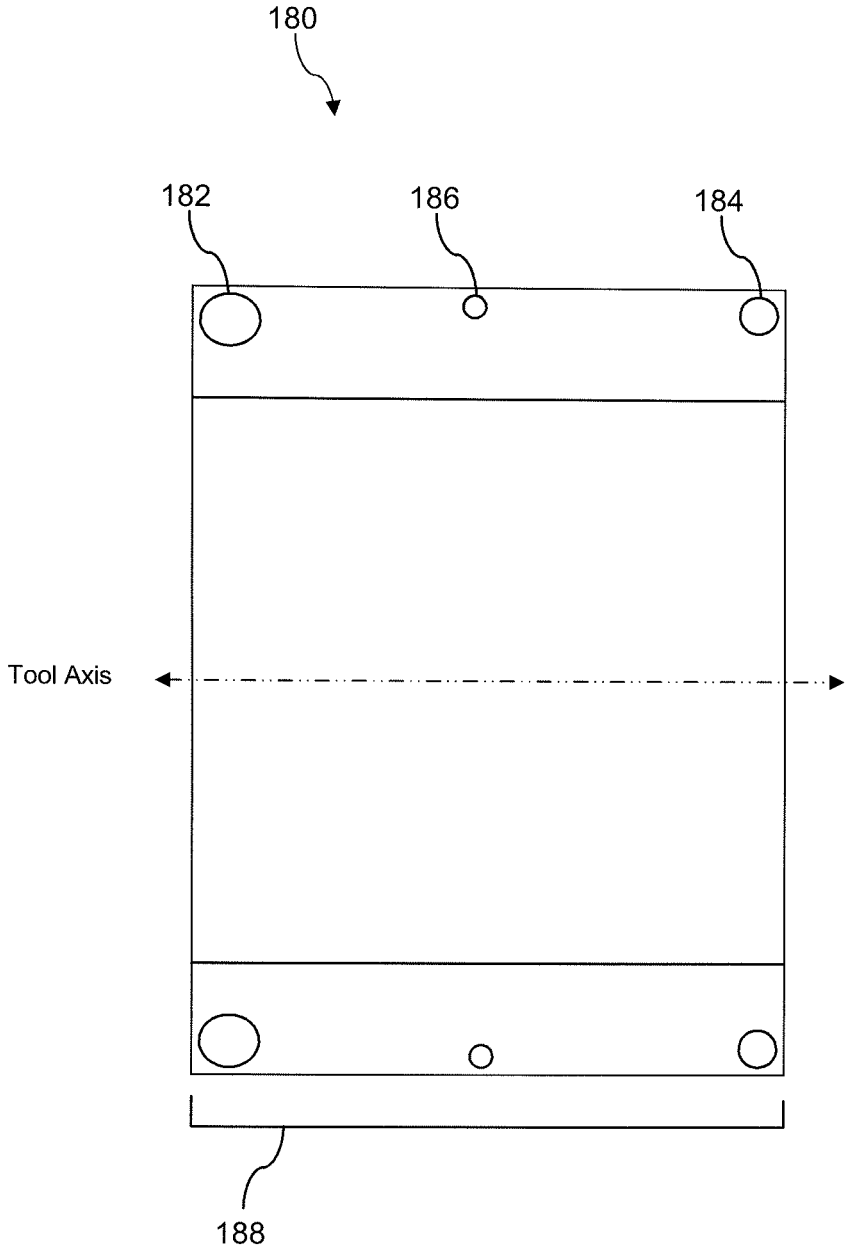
FIG. 5 is an illustration of a packing element in axial section view according to an embodiment of the disclosure.

Turning now to FIG. 5, an embodiment of an asymmetric packing element 180 is described. The packing element 180 is shown in axial section view in FIG. 5. A transverse section view of packing element 180 would be similar to FIG. 4B. The packing element 180 may be comprised of rubber or of some other elastomeric material. In an embodiment, the packing element 180 may be substantially similar to the packing element 170, with the exception that packing element 180 further comprises a retaining means 186 located in substantially the longitudinal center of the packing element 180. The retaining means 186 may serve to restrain, attenuate, and/or retard the swelling of a middle portion of the packing element 180 during the setting of the tool 100 and the pack-off of the packing element 180 to promote a desired sequence of swelling and/or expansion of the end of the packing element 180 opposite to the point of application of compression force, the middle portion of the packing element 180, and the end of the packing element proximate to the compression force. The retaining means may further serve to assist in retracting the middle portion of the packing element 180 when the compression force on the packing element 180 is released before retrieving the tool 100 from the wellbore. The retaining means 186 may comprise any of a spring, an elastomer, a bungee, or a combination of these. In an embodiment, the packing element 180 may be produced without the tensioner devices 182, 184. The packing element 180 comprises a body section 188 and may comprise one or more lugs (not shown) as discussed above with reference to FIG. 2A. When the packing element 180 is said to be asymmetrical this characterization is relative at least to the asymmetrical structure of the body section 188.

Figure 6A:
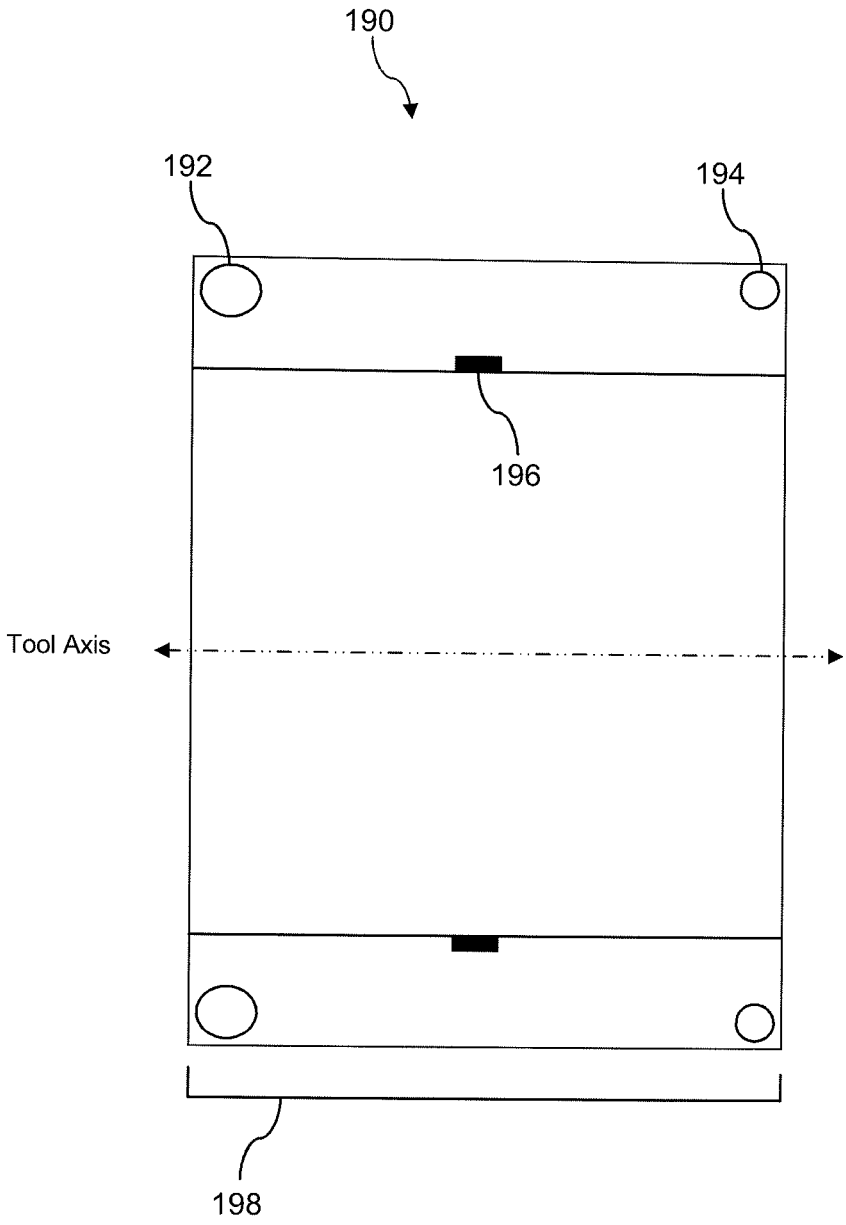
FIG. 6A is an illustration of a packing element in axial section view according to an embodiment of the disclosure.
Figure 6B:
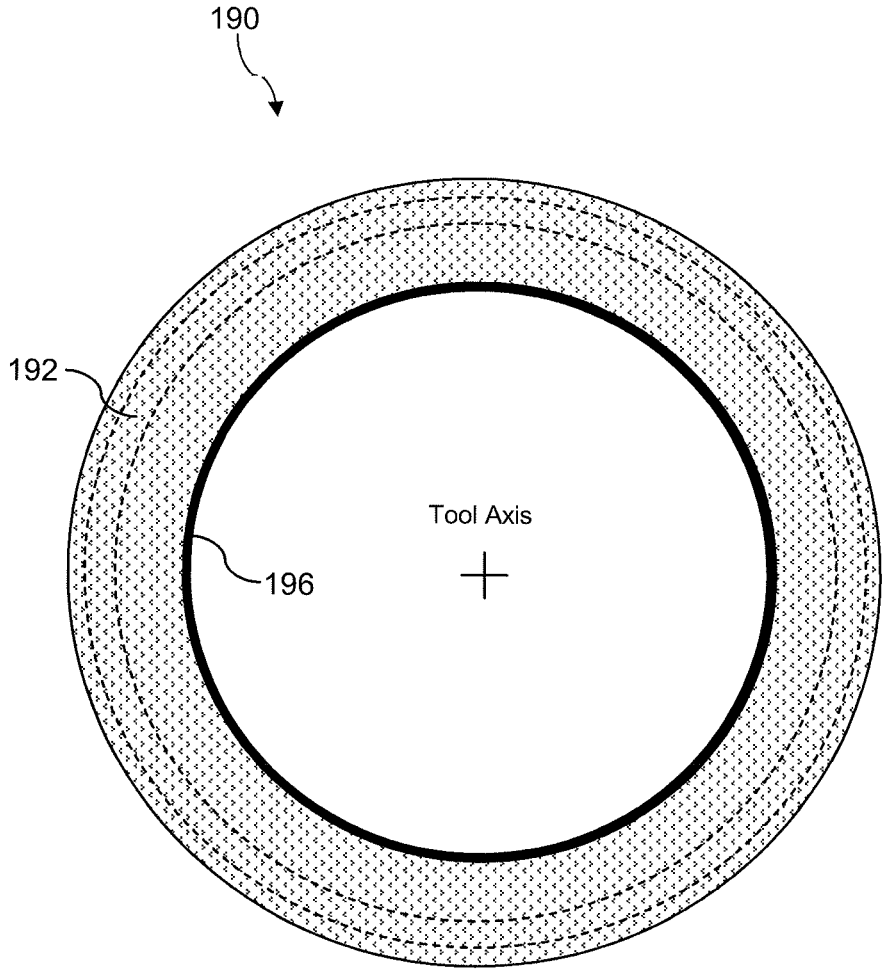
FIG. 6B is an illustration of a packing element in transverse section view according to an embodiment of the disclosure.

Turning now to FIG. 6A, an embodiment of an asymmetric packing element 190 is described. The packing element 190 is shown in axial section view in FIG. 6A and in transverse section view in FIG. 6B. The packing element 190 may be comprised of rubber or of some other elastomeric material. In an embodiment, the packing element 190 may be substantially similar to the packing element 180, with the exception that in the packing element 190 the retaining means 196 is located proximate to the interior surface of the packing element 190. The retaining means 196 may comprise any of a spring, an elastomer, a bungee, or a combination of these. In an embodiment, the packing element 190 may be produced without the tensioner devices 192, 194. The packing element 190 comprises a body section 198 and may comprise one or more lugs (not shown) as discussed above with reference to FIG. 2A. When the packing element 190 is said to be asymmetrical this characterization is relative at least to the asymmetrical structure of the body section 198.

Figure 7A:
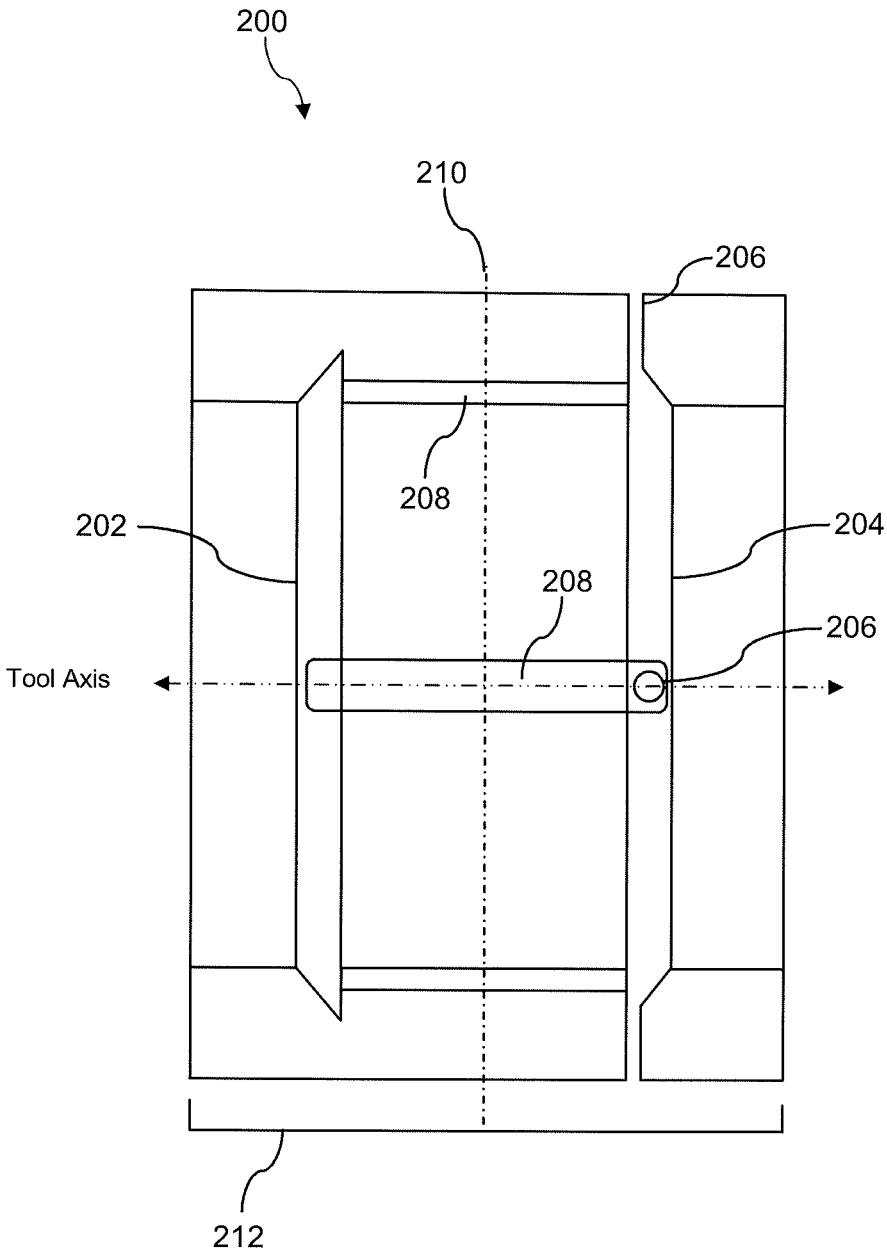
FIG. 7A is an illustration of a packing element in axial section view according to an embodiment of the disclosure.

Turning now to FIG. 7A, an embodiment of an asymmetric packing element 200 is described. The packing element 200 may be comprised of rubber or of some other elastomeric material. The packing element 200 may be disposed around a mandrel, for example around the mandrel 104. The packing element 200 is configured to provide a pressure barrier activated by compression force when a pressure differential across the packing element 200 has a first direction and to provide a pressure barrier activated by the pressure differential across the packing element 200 when the pressure differential across the packing element 200 has a direction opposite the first direction. Activating the pressure barrier by the pressure differential across the packing element 200 may be referred to as activation boost, pressure barrier boost, sealing boost, or boost. In an embodiment, the pressure barrier created by the packing element 200 when the pressure differential across the packing element 200 has a direction opposite the first direction may be partly activated due to compression force in the packing element 200 as well as partly activated due to the pressure differential across the packing element 200 or the boost.

In an embodiment, the packing element 200 defines a fourth groove 202 and a fifth groove 204 on an interior surface. The packing element 200 has a central transverse axis 210. A plane perpendicular to the tool axis that intersects the central transverse axis 210 may be said to define a longitudinal center of the packing element 200 as the intersection of this plane with the packing element 200. The packing element 200 may define a plurality of through holes 206 to promote venting of fluids and/or gases when the packing element 200 is compressed, to avoid a pressure lock condition as well as to energize the seal as discussed further hereinafter. In a preferred embodiment of the packing element 200, the through holes 206 are located on the side of the central transverse axis 210 towards the end of the packing element 200 opposite to the point of application of compression force. At least the off-center location of the through holes 206 make the packing element 200 asymmetrical. The packing element 200 comprises a body section 212 and may comprise one or more lugs (not shown) as discussed above with reference to FIG. 2A. When the packing element 200 is said to be asymmetrical this characterization is relative at least to the asymmetrical structure of the body section 212. In some contexts, one of the through holes 206 may be said to be a vent hole through the packing element 200 and/or a vent hole through the body section 212. In some contexts, the grooves 202, 204 may be referred to as transverse grooves.

The packing element 200 further defines one or more axial grooves 208 that are substantially parallel with the tool axis and that extend from one of the through holes 206, across the central transverse axis 210, towards the end of the packing element 200 proximate to the point of application of the compression force to the packing element 200. In an embodiment, the axial grooves 208 may extend to the fourth groove 202. In an embodiment, the number of axial grooves 208 is the same as the number of through holes 206. Alternatively, in another embodiment, the number of axial grooves 208 may be different from the number of through holes 206. For example, in an embodiment, the number of through holes 206 may be greater than the number of axial grooves 208. In an embodiment, one or more or all of the axial grooves 208 may not be substantially parallel to the tool axis but instead may be at an angle to the tool axis, and in this context the axial groove 208 may be referred to by a different term, such as a diagonal groove 208, an extended groove 208, a communicating groove 208, or some other appropriate term.

The grooves 202, 204, 208 may be molded in the packing element 200 during manufacture. Alternatively, the grooves 202, 204, 208 may be cut or scalloped out of the packing element 200 after an initial manufacturing step. In one or more embodiments, the through holes 206 may be propped and/or reinforced by tubes and/or partial length tubes, stents, spring devices, and/or other structures to reduce a tendency for the through holes 206 to close in response to deformation of the packing element 200. In an embodiment, some of the through holes 206 may be propped and/or reinforced while other through holes 206 are not propped or reinforced.

In an embodiment, the end of the packing element 200 opposite to the point of application of the compression force to the packing element 200 is disposed against the stop 106 over the mandrel 104, and the compressor 108 exerts a compression force originating from the end of the packing element 200 adjacent to the compressor 108 and directed axially towards the end of the packing element 200 opposite to the compressor 108. In an embodiment, the packing element 200 may expand according to the sequence described above with reference to FIG. 1A frames B, C, and D. Alternatively, in an embodiment, the packing element 200 may expand according to the sequence described above with reference to FIG. 1B frames B, C, and D. Alternatively, in an embodiment, the packing element 200 may expand in a sequence where the end of the packing element 200 proximate to the compression force expands before the end of the packing element 200 opposite to the application of the compression force (the end proximate to the through holes 206).

Figure 7B:
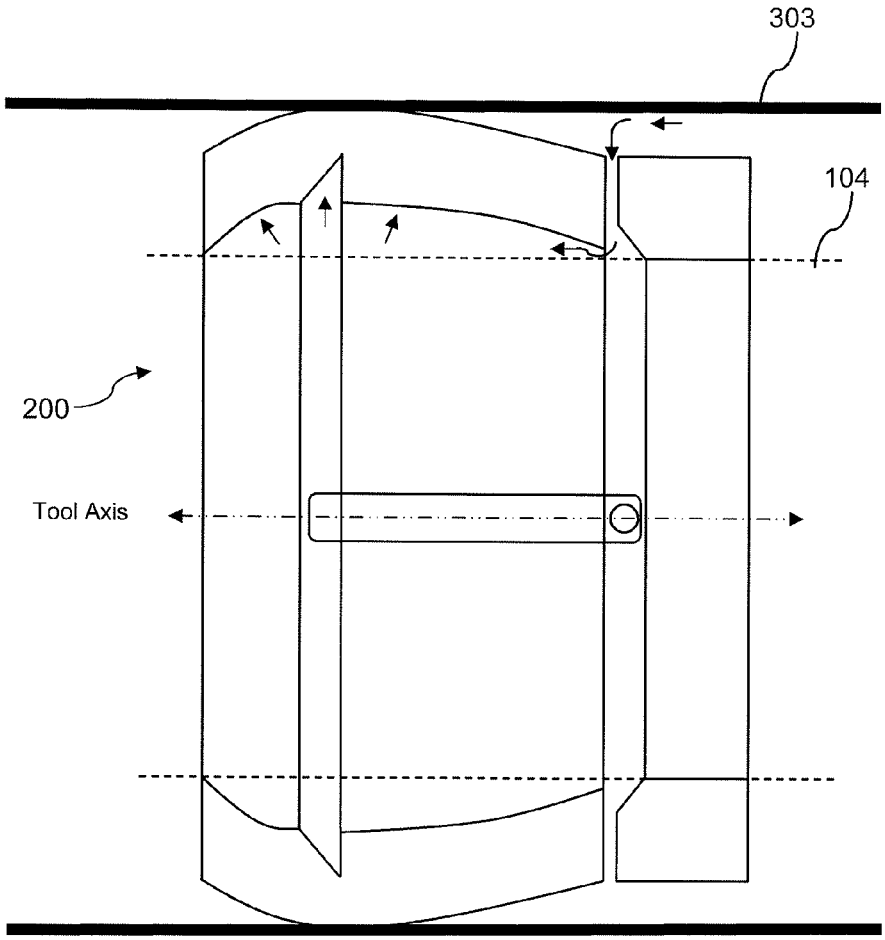
FIG. 7B is an illustration of a packing element in axial section view showing a seal between a packing element and a casing energized by a pressure differential.

In an embodiment, when the packing element 200 is deployed with the tool 100 in a wellbore, when the pressure in the annulus formed between the casing wall and the tool 100 is greater at the end of the packing element 200 proximate to the stop 106 than the pressure in the annulus at the end of the packing element 200 proximate to the compressor 108, the pressure in the annulus at the end of the packing element 200 equalizes via the through holes 206 to the axial grooves 208 and acts to energize the seal between the packing element 200 and the casing wall, for example by at least partially inflating the packing element 200 and pressing it with increased force against the casing wall, as best seen in FIG. 7B, for example around the fourth groove 202. By contrast, when the pressure in the annulus is greater at the end of the packing element 200 proximate to the compressor 108 than at the end of the packing element 200 proximate to the stop 106, the seal is maintained based on compression force loaded into the packing element 200 during pack-off and/or setting of the packing element 200. It is understood that the energizing of the packing element 200 in the context of a specific pressure differential may be additive to the seal provided by the compression force loaded into the packing element 200 during pack-off.

Figure 8:
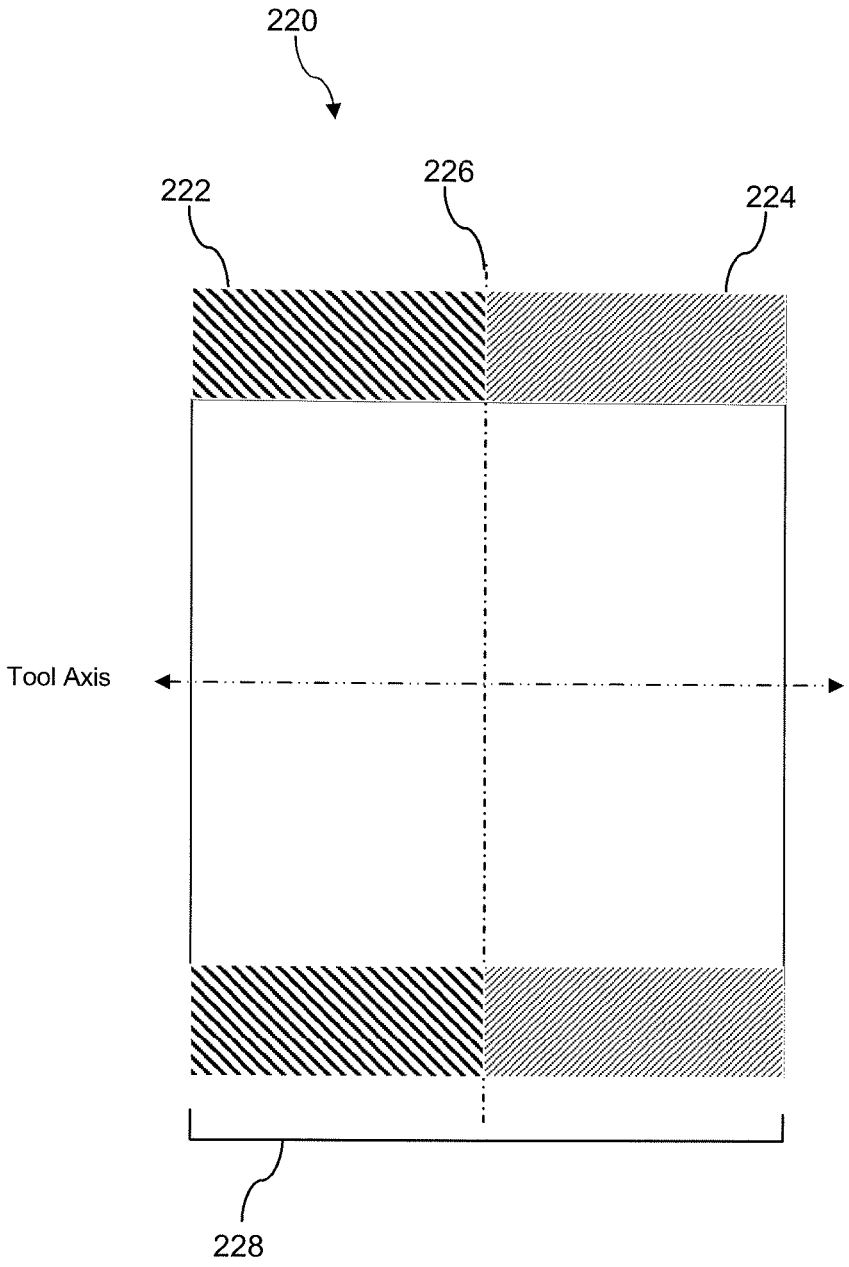
FIG. 8 is an illustration of a packing element in axial section view according to an embodiment of the disclosure.

Turning now to FIG. 8, an asymmetrical packing element 220 is described. The packing element 220 is shown in axial section view in FIG. 8 and has central transverse axis 226. It is understood that the packing element 220 may have a transverse section view similar to that shown in FIG. 2B, without the dotted line representing the first groove 132. The packing element 220 may be comprised of rubber or of some other elastomeric materials. In an embodiment, the packing element 220 is comprised of a first material 222 having a first hardness and a second material 224 having a second hardness. The first hardness is greater than the second hardness, and therefore the second material 224 is expected to begin to swell with less compression force loading and the first material 222 is expected to begin to swell later, with greater compression force loading. The different hardness of the materials 222, 224 makes the packing element 220 asymmetrical. The packing element 220 comprises a body section 228 and may comprise one or more lugs (not shown) as discussed above with reference to FIG. 2A. When the packing element 220 is said to be asymmetrical, this characterization is relative at least to the asymmetrical structure of the body section 228. In an embodiment, the packing element 220 may comprise one or more through holes (not shown) to vent pressure, for example by venting fluids and/or gases, to avoid a pressure lock condition. In one or more embodiments, the through holes may be propped and/or reinforced by tubes and/or partial length tubes, stents, spring devices, and/or other structures to reduce a tendency for the through holes to close in response to deformation of the packing element 220 under compression forces. In an embodiment, some of the through holes may be propped and/or reinforced while other through holes are not propped or reinforced. In some contexts, one of the through holes may be said to be a vent hole through the packing element 220 and/or a vent hole through the body section 228.

In an embodiment, the second hardness may be at least 60 durometer hardness. In an embodiment, the first hardness may be no more than 100 durometer hardness. Alternatively, the first and second hardnesses may be characterized according to a different hardness unit. In an embodiment, the first material may be less resilient than the second material. In an embodiment, the end of the packing element 220 including the second material 224 is disposed against the stop 106 over the mandrel 104, and the compressor 108 exerts a compression force originating from the end of the packing element 220 including the first material 222 and directed axially towards the first material 222. It is anticipated that the packing element 220 will expand according to the sequence described above with reference to FIG. 1A frames B, C, and D. Alternatively, the packing element 220 may expand according to the sequence described above with reference to FIG. 1B frames B, C, and D.

In an embodiment, the asymmetrical packing element 220 may comprise a single material whose stiffness and/or chemical compounding is varied along the axis of the asymmetrical packing element 220. For example, the asymmetrical packing element 220 may be composed of a single material containing an admixture of carbon black, fibers, and/or other stiffeners mixed into the single material in different concentrations along the axis of the asymmetrical packing element 220, thereby varying the stiffness of the asymmetrical packing element 220 along its axis. Likewise, some chemical property or treatment of the single material comprising the asymmetrical packing element 220 may be varied along its axis during manufacturing and/or fabrication, thereby varying the responsiveness of the asymmetrical packing element 220 along its axis to compression.

Figure 9:
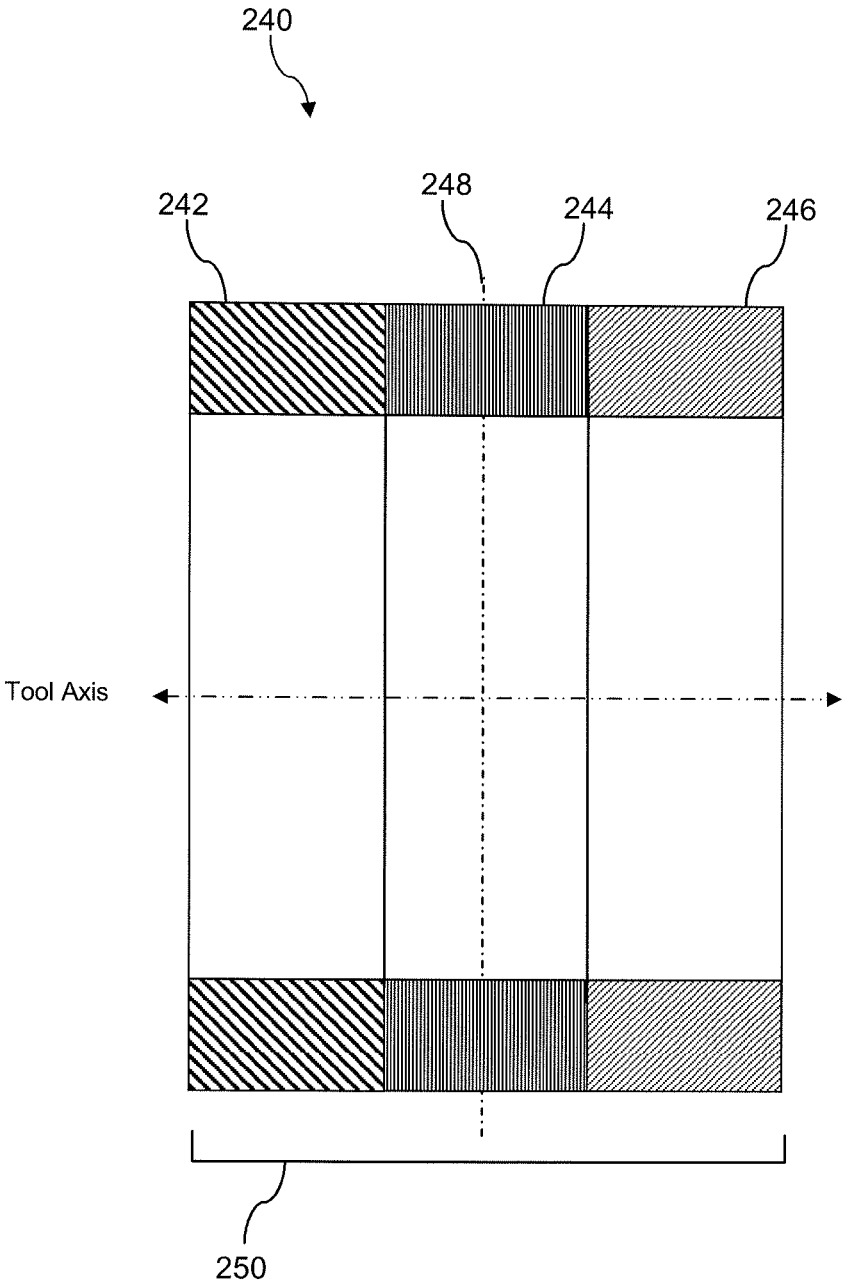
FIG. 9 is an illustration of a packing element in axial section view according to an embodiment of the disclosure.

Turning now to FIG. 9, an asymmetrical packing element 240 is described. The packing element 240 is shown in axial section view in FIG. 9 and has central transverse axis 248. It is understood that the packing element 240 may have a transverse section view similar to that shown in FIG. 2B, without the dotted line representing the first groove 132. The packing element 240 comprises a body section 250 and may comprise one or more lugs (not shown) as discussed above with reference to FIG. 2A. When the packing element 240 is said to be asymmetrical this characterization is relative at least to the asymmetrical structure of the body section 250. The packing element 240 may be comprised of rubber or of some other elastomeric materials. The packing element 220 is comprised of a third material 242 having a third hardness, a fourth material 244 having a fourth hardness, and a fifth material 246 having a fifth hardness. The third hardness is greater than the fourth hardness, and the fourth hardness is greater than the fifth hardness. The different hardness of the materials 242, 244, 246 makes the packing element 240 asymmetrical. The variation of the hardness of the different materials is expected to affect the readiness of the respective materials to swell under compression force loading. In an embodiment, the fifth material is expected to begin to swell first with the least amount of compression force loading; the fourth material is expected to begin to swell second with an increased amount of compression force loading; and the third material is expected to begin to swell third with yet further increased amount of compression force loading. In an embodiment, the packing element 240 may comprise one or more through holes (not shown) to vent pressure, for example to vent fluid and/or gases, to avoid a pressure lock condition. In one or more embodiments, the through holes may be propped and/or reinforced by tubes and/or partial length tubes, stents, spring devices, and/or other structures to reduce a tendency for the through holes to close in response to deformation of the packing element 240 under compression forces. In an embodiment, some of the through holes may be propped and/or reinforced while other through holes are not propped or reinforced. In some contexts, one of the through holes may be said to be a vent hole through the packing element 240 and/or a vent hole through the body section 250.

In an embodiment, the fifth hardness may be at least 60 durometer hardness. In an embodiment, the third hardness may be no more than 100 durometer hardness. The fourth hardness is intermediate between the fifth hardness and the third hardness. In an embodiment, the end of the packing element 240 including the fifth material 246 is disposed against the stop 106 over the mandrel 104, and the compressor 108 exerts a compression force originating from the end of the packing element 240 including the third material 242 and directed axially towards the first material 242. It is anticipated that the packing element 240 will expand according to the sequence described above with reference to FIG. 1A frames B, C, and D. Alternatively, the packing element 240 may expand according to the sequence described above with reference to FIG. 1B frames B, C, and D. It is understood that other embodiments of the packing element 240 may be comprised of four, five, or more materials of varying hardness that monotonically decreases from the end of the packing element 240 proximate to the point of application of the compression force to the end of the packing element 240 opposite to the point of application of the compression force. Furthermore, in another embodiment, the packing element 240 may comprise four, five, or more materials of varying hardness in some other arrangement than monotonically decreasing.

A number of different embodiments of asymmetrical packing elements have been described above, each suitable for use in place of the packing element 102 in the tool 100 described above with reference to FIG. 1A. It is understood that features of two or more different embodiments may combined in a single packing element.

Figure 10:
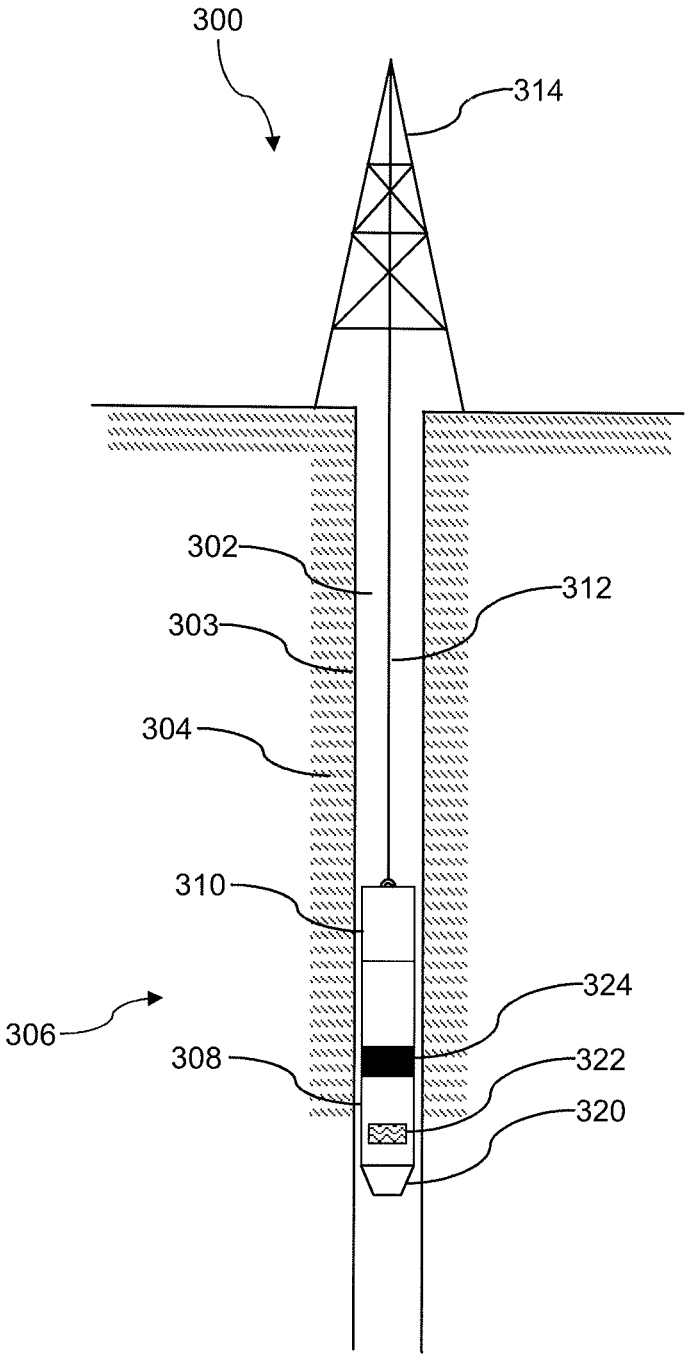
FIG. 10 is an illustration of a wellbore servicing system according to an embodiment of the disclosure.

Turning now to FIG. 10, a wellbore servicing system 300 is described. The system 300 comprises a servicing rig 314 that extends over and around a wellbore 302 that penetrates a subterranean formation 304 for the purpose of recovering hydrocarbons, storing hydrocarbons, disposing of carbon dioxide, or the like. The wellbore 302 may be drilled into the subterranean formation 304 using any suitable drilling technique. While shown as extending vertically from the surface in FIG. 10, in some embodiments the wellbore 302 may be deviated, horizontal, and/or curved over at least some portions of the wellbore 302. Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. While in FIG. 10, the wellbore 302 is illustrated as being cased with casing 303, the wellbore 302 may be cased, contain tubing, and may generally comprise a hole in the ground having a variety of shapes and/or geometries as is known to those of skill in the art.

The servicing rig 314 may be one of a drilling rig, a completion rig, a workover rig, a servicing rig, or other mast structure and supports a toolstring 306 and a conveyance 312 in the wellbore 302, but in other embodiments a different structure may support the toolstring 306 and the conveyance 312, for example an injector head of a coiled tubing rigup. In an embodiment, the servicing rig 314 may comprise a derrick with a rig floor through which the toolstring 306 and conveyance 312 extends downward from the servicing rig 314 into the wellbore 302. In some embodiments, such as in an offshore location, the servicing rig 314 may be supported by piers extending downwards to a seabed. Alternatively, in some embodiments, the servicing rig 314 may be supported by columns sitting on hulls and/or pontoons that are ballasted below the water surface, which may be referred to as a semi-submersible platform or rig. In an off-shore location, a casing may extend from the servicing rig 314 to exclude sea water and contain drilling fluid returns. It is understood that other mechanical mechanisms, not shown, may control the run-in and withdrawal of the toolstring 306 and the conveyance 312 in the wellbore 302, for example a draw works coupled to a hoisting apparatus, a slickline unit or a wireline unit including a winching apparatus, another servicing vehicle, a coiled tubing unit, and/or other apparatus.

The toolstring 306 may comprise one or more downhole tools, for example a retrievable bridge plug 308 and a setting tool 310. Alternatively, the toolstring 306 may comprise a different downhole tool, for example a retrievable packer. In some contexts, the retrievable bridge plug 308 may be referred to as a downhole dual directional isolation tool or a downhole wireline retrievable dual directional isolation tool, and having a lower end 320. In some contexts, the lower end 320 may be referred to as a bull plug. The conveyance 312 may be any of a string of jointed pipes, a slickline, a coiled tubing, a wireline, and other conveyances for the toolstring 306. In another embodiment, the toolstring 306 may comprise additional downhole tools located above or below the retrievable bridge plug 308. Additionally, the toolstring 306 may not include the retrievable bridge plug 308 but may include instead an alternate dual directional isolation tool. In an embodiment, the toolstring 306 may include one or more of a retrievable packer assembly, a retrievable straddle packer assembly, and/or other packer assemblies or packer subassemblies. It is contemplated that any of these packers, bridge plugs, and/or zonal isolation plugs may comprise a packing element incorporating one or a combination of the novel packing element structures described in detail above.

The toolstring 306 may be coupled to the conveyance 312 at the surface and run into the wellbore casing 303, for example a wireline unit coupled to the servicing rig 314 may run the toolstring 306 that is coupled to a wireline into the wellbore casing 303. In an embodiment, the conveyance may be a wireline, an electrical line, a coiled tubing, or other conveyance. The toolstring 306 may be run past the target depth and retrieved to approximately the target depth, for example to assure that the toolstring 306 reaches target depth. At target depth, the setting tool 310 may be activated to set the retrievable bridge plug 308 in the wellbore casing 303. The setting tool 310 may activate in response to a signal sent from the surface and/or in response to the expiration of a timer incorporated into the setting tool 310.

In an embodiment, the setting tool 310 may capture or grip an inner mandrel of the retrievable bridge plug 308 and apply compression force to a sleeve structure operable to slide over the inner mandrel, for example the compressor 108 of FIG. 1. The compression force first causes slips 322 of the retrievable bridge plug 308 to deploy and engage the wellbore casing 303. As the setting tool 310 continues to increase the application of compression force, an asymmetrical packing element 324 of the retrievable bridge plug 308 expands in one of the two sequences identified above for the several different types of asymmetrical packing elements described above. The end of the asymmetrical packing element 324 away from the point of application of the compression force swells and engages the wellbore casing 303 before the end of the asymmetrical packing element 324 that is proximate to the point of application of the compression force swells and engages the wellbore casing 303. In an embodiment, a retaining means of the asymmetrical packing element 324, for example as described with reference to FIG. 5 and FIG. 6A above, may be employed to delay or retard the expansion of the middle portion of the asymmetrical packing element 324. Likewise, a tensioner device of the asymmetrical packing element 324 located proximate to the point of application of the compression force, for example as described with reference to FIG. 4 above, may be employed to delay or retard the expansion of an end of the asymmetrical packing element 324 proximate to the point of application of the compression force. In an embodiment, such as that described above with reference to FIG. 7A, a pressure differential may contribute to energizing the seal between the asymmetrical packing element 324 and the wellbore casing 303.

It will be readily understood by one skilled in the art that the retrievable bridge plug 308 can be designed to promote application of compression force in a downhole direction or in an uphole direction. When compression force is applied downhole to the asymmetrical packing element 324, the stop 106 illustrated in FIG. 1A may be downhole relative to the location of the asymmetrical packing element 324, the compressor 108 illustrated in FIG. 1A may be uphole relative to the location of the asymmetrical packing element 324, and the setting tool 310 may have a member that captures or grips the compressor 108 and extends into the retrievable bridge plug 308 to apply compression force. Alternatively, when compression force is applied uphole to the asymmetrical packing element 324, the stop 106 may be uphole relative to the location of the asymmetrical packing element 324, the compressor 108 may be downhole relative to the location of the asymmetrical packing element 324, the setting tool 310 may have a member that extends into the retrievable bridge plug 308 to capture or grip the compressor 108, and applies compression force to the asymmetrical packing element 324 by retracting or pulling out the compressor 108. In this case, the setting tool 310 may have an additional mechanism for setting the slips 322.

After fully deploying the asymmetrical packing element 324, continued application of compression force by the setting tool 310 may cause a latching mechanism of the retrievable bridge plug 308 to latch the compression forces loaded into the packing element 324. For example, the compressor 108 of FIG. 1A may be latched to hold the applied compression forces. Further application of compression force by the setting tool 310 may cause a coupling mechanism attaching the setting tool 310 to the retrievable bridge plug 308 to shear, de-couple, and/or release, thereby allowing withdrawal of the setting tool 310 from the wellbore 302.

The retrievable bridge plug 308 may be placed in the wellbore casing 303 to serve a variety of purposes. The retrievable bridge plug 308 may be installed above the uppermost production zone to seal the upper end of the wellbore casing 303, to temporarily stop production, in order to remove a wellhead, also referred to as a Christmas tree, to replace or service the wellhead. After reinstallation of the wellhead, the retrievable bridge plug 308 may be retrieved from the wellbore casing 303. The retrievable bridge plug 308 may be placed in the wellbore casing 303 to seal off non-producing formations below the lowermost production zone, thus isolating the lowermost production zone from the remaining wellbore 302 below production. The retrievable bridge plug 308 may be placed in the wellbore casing 303 above the uppermost production zones to suspend production, for example temporary well abandonment. The retrievable bridge plug 308 may be placed in the wellbore casing 303 to test tubing. The retrievable bridge plug 308 may be placed in the wellbore casing 303 to promote setting of a completion packer. Those skilled in the art will appreciate that yet other applications of the retrievable bridge plug 308 are contemplated by the present disclosure and may advantageously employ the asymmetrical packing element 102, 324 taught by the present disclosure.

To retrieve the retrievable bridge plug 308, a retrieval tool (not shown) may be run into the wellbore 302 on the conveyance 312 to the retrievable bridge plug 308 where the retrieval tool may couple to the retrievable bridge plug 308. The service rig 314 may exert upwards force on the conveyance 312 until a shear pin, shear screw, shear ring and/or other decoupling device in the retrievable bridge plug 308 securing the latching mechanism shears or otherwise releases. With the latching mechanism thus released, the asymmetrical packing element 324 relaxes and disengages from the wellbore casing 303. In an embodiment, components of the asymmetrical packing element 324 may contribute to the relaxation and restoration of the asymmetrical packing element 324 to approximately its original shape, for example one or more tensioners and/or retaining means, as discussed above with reference to FIG. 4A, FIG. 5, and FIG. 6A, may retract the asymmetrical packing element 324 at least partially back to its original shape. The tensioners and/or retaining means, when used, may be said to retract the end portions and/or the middle portions of the asymmetrical packing element 308. After the release of the asymmetrical packing element 324, further exertion of upwards force on the conveyance 312 by the service rig 314 may cause the slips 322, that may be spring loaded to the retracted position, to retract, thereby releasing the retrievable bridge plug 308 from the wellbore casing 303. The retrievable bridge plug 308 may then be retrieved completely from the wellbore 302.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole retrievable dual directional isolation tool, comprising:

a mandrel;

a compressor concentric with the mandrel; and a packing element disposed around the mandrel, wherein a body section of the packing element is asymmetrical, wherein the asymmetricality of the body section of the packing element is provided by an inside surface of the body section of the packing element that defines one or more transverse grooves, wherein if a single transverse groove is present, the single transverse groove is located off a longitudinal center of the body section of the packing element and wherein if a plurality of transverse grooves are present, the longitudinal center of the plurality of transverse grooves is located off a longitudinal center of the body section of the packing element.

2. The tool of claim 1, wherein the single transverse groove is located off the longitudinal center of the body section of the packing element away from the compressor or the plurality of transverse grooves is located off the longitudinal center of the body section of the packing element away from the compressor.

3. The tool of claim 1, wherein a first end of the body section of the packing element comprises first material and a second end of the body section of the packing element comprises a second material, wherein the first end is located proximate to the compressor, and wherein the first material is harder than the second material.

4. The tool of claim 3, wherein the first material comprises a first rubber material and the second material comprises a second rubber material, and wherein the second rubber material has at least a 60 durometer hardness.

5. The tool of claim 3, wherein the body section of the packing element comprises a vent hole through the body section, wherein the vent hole is located off the longitudinal center of the body section of the packing element away from the compressor, and wherein an interior surface of the body section of the packing element defines a groove extending from the vent hole across the longitudinal center of the body section of the packing element towards the compressor.

6. The tool of claim 5, wherein a first end of the body section of the packing element comprises a first transverse tensioner and a second end of the body section of the packing element comprises a second transverse tensioner, wherein the first end is located proximate to the compressor, wherein the first transverse tensioner is stronger than the second transverse tensioner.

7. The tool of claim 1, wherein the body section of the packing element comprises a vent hole through the body section, wherein the vent hole is located off a longitudinal center of the body section of the packing element away from the compressor and wherein an interior surface of the body section of the packing element defines a groove extending from the vent hole across the longitudinal center of the body section of the packing element towards the compressor.

8. The tool of claim 1, wherein a first end of the body section of the packing element comprises a first transverse tensioner and a second end of the body section of the packing element comprises a second transverse tensioner, wherein the first end is located proximate to the compressor, and wherein the first transverse tensioner is stronger than the second transverse tensioner.

9. The tool of claim 8, wherein the first end of the body section of the packing element comprises a first material and the second end of the body section of the packing element comprises a second material, and wherein the first material is harder than the second material.

10. The tool of claim 8, wherein an inside surface of the body section of the packing element defines at least one transverse groove, wherein a longitudinal center of the at least one groove is located off a longitudinal center of the body section of the packing element and away from the compressor, wherein a first end of the body section of the packing element comprises a first transverse tensioner and a second end of the body section of the packing element comprises a second transverse tensioner, wherein the first end is located proximate to the compressor, and wherein the first transverse tensioner is stronger than the second transverse tensioner, wherein the body section of the packing element comprises a vent hole through the body section, wherein the vent hole is located off the longitudinal center of the body section of the packing element away from the compressor, and wherein an interior surface of the body section of the packing element defines a groove extending from the vent hole across the longitudinal center of the body section of the packing element towards the compressor.

11. The tool of claim 1, wherein the body section comprises a vent hole through the body section and wherein the vent hole is reinforced.

12. The tool of claim 11, wherein the vent hole is reinforced by at least one of a tube, a stent, and a spring.

13. A method of servicing a wellbore, comprising:

deploying a downhole dual directional isolation tool on a wireline or an electrical line into as wellbore casing, wherein the downhole dual directional isolation tool has an asymmetrical packing element;

applying a compression force to a first end of the packing element;

expanding a second end of the packing element to seal against a wall of the casing by continued application of the compression force, where the second end is opposite the first end of the packing element;

after expanding the second end of the packing element to seal against the wall of the casing, expanding the first end of the packing element to seal against the wall of the casing by continued application of the compression force, and energizing the seal formed between the packing element and the wall of the casing by a fluid pressure differential in an annulus formed between the casing wall and the downhole dual directional isolation tool, across the packing element, wherein the fluid pressure differential partially inflates the packing element.

14. The method of claim 13, further comprising delaying the expansion of a middle portion of the packing element to seal against the wall of the casing until after expanding the second end of the packing element to seal against the wall of the casing.

15. The method of claim 14, further comprising expanding the middle portion of the packing element to seal against the wall of the casing before expanding the first end of the packing element to seal against the wall of the casing.

16. The method of claim 14, further comprising retracting the middle portion of the packing element to release the seal formed between the middle portion of the packing element and the wall of the casing.

17. A downhole retrievable dual directional isolation tool, comprising:

a mandrel;

a compressor concentric with the mandrel; and a packing element disposed around the mandrel, wherein the packing element comprises elastomeric material and wherein a body section of the packing element is asymmetrical, wherein the asymmetricality of the body section of the packing element is provided by a first transverse tensioner and a second transverse tensioner, wherein a first end of the body section of the packing element comprises the first transverse tensioner, a second end of the body section of the packing element comprises the second transverse tensioner, and the first transverse tensioner is stronger than the second transverse tensioner.

18. The tool of claim 17, wherein a first end of the body section of the packing element is located proximate to the compressor.

19. The tool of claim 18, wherein the first transverse tensioner is a first spring and the second transverse tensioner is a second spring, wherein the first spring is stronger than the second spring.

20. The tool of claim 17, wherein the body section of the packing element comprises a retaining means located in substantially the longitudinal center of the body section of the packing element to retard the swelling of a middle longitudinal portion of the body section of the packing element during setting of the tool and to retract the middle longitudinal portion of the body section of the packing element during unsetting of the tool.

21. The tool of claim 17, wherein the first end of the body section of the packing element comprises a first material and the second end of the body section of the packing element comprises a second material, and wherein the first material is harder than the second material.

22. The tool of claim 17, wherein the body section of the packing element comprises a vent hole through the body section, wherein the vent hole is located off a longitudinal center of the body section of the packing element away from the compressor, and wherein an interior surface of the both section of the packing element defines a groove extending from the vent hole across the longitudinal center of the body section of the packing element towards the compressor.

23. The tool of claim 22, wherein the vent hole is reinforced by at least one of a tube, a stent, and a spring.

24. The tool of claim 22, wherein the first end of the body section of the packing element comprises a first material and the second end of the body section of the packing element comprises a second material, wherein the first material is harder than the second material.

25. The tool of claim 17, wherein the body section comprises is vent hole through the body section and wherein the vent hole is reinforced.

26. The tool of claim 25, wherein the vent hole is reinforced by at least one of a tube, a stem, and a spring.

* * * * *

UNITED STATES PATENT AND TRADEMARK OFFICE

CERTIFICATE OF CORRECTION

PATENT NO. : 8,602,116 B2
APPLICATION NO. : 12/758411
DATED : December 10, 2013
INVENTOR(S) : James Crabb It is certified that error appears in the above-identified patent and that said Letters Patent is hereby corrected as shown below:

In the Claims

In Column 24, Claim 25, line 43, replace "is vent hole" with --a vent hole--.

In Column 24, Claim 26, line 46, replace "stem" with --stent--.

Signed and Sealed this
Twenty-fifth Day of February, 2014

Michelle K. Lee

Michelle K. Lee
*Deputy Director of the United States Patent and Trademark Office*